US010134334B2

(12) United States Patent
Piper et al.

(10) Patent No.: US 10,134,334 B2
(45) Date of Patent: Nov. 20, 2018

(54) LUMINANCE UNIFORMITY CORRECTION FOR DISPLAY PANELS

(71) Applicant: Apple Inc., Cupertino, CA (US)

(72) Inventors: Johan L. Piper, Cupertino, CA (US); James C. Aamold, Campbell, CA (US); Shengkui Gao, San Jose, CA (US); Hung Sheng Lin, San Jose, CA (US); Hyunwoo Nho, Stanford, CA (US)

(73) Assignee: Apple Inc., Cupertino, CA (US)

( * ) Notice: Subject to any disclaimer, the term of this patent is extended or adjusted under 35 U.S.C. 154(b) by 158 days.

(21) Appl. No.: 15/262,449

(22) Filed: Sep. 12, 2016

(65) Prior Publication Data

US 2017/0032742 A1 Feb. 2, 2017

Related U.S. Application Data

(63) Continuation-in-part of application No. 15/064,230, filed on Mar. 8, 2016.

(60) Provisional application No. 62/146,185, filed on Apr. 10, 2015.

(51) Int. Cl.
*G09G 3/36* (2006.01)
*G09G 3/3233* (2016.01)

(52) U.S. Cl.
CPC ... *G09G 3/3233* (2013.01); *G09G 2300/0842* (2013.01); *G09G 2320/0223* (2013.01); *G09G 2320/0233* (2013.01); *G09G 2320/0295* (2013.01); *G09G 2360/145* (2013.01)

(58) Field of Classification Search
CPC ..... G06F 3/041; G06F 3/045; G01R 27/26; G02F 1/1343; H01L 27/32; G09G 3/36
See application file for complete search history.

(56) References Cited

U.S. PATENT DOCUMENTS

| | | | | |
|---|---|---|---|---|
| 6,414,661 | B1 | 7/2002 | Shen et al. | |
| 7,321,348 | B2 | 1/2008 | Cok et al. | |
| 7,948,392 | B2 | 5/2011 | Smith et al. | |
| 2004/0070558 | A1* | 4/2004 | Cok | G09G 3/3225 345/76 |
| 2004/0212577 | A1* | 10/2004 | Takeda | G09G 3/3648 345/99 |
| 2006/0077135 | A1 | 4/2006 | Cok et al. | |
| 2006/0170623 | A1 | 8/2006 | Naugler et al. | |

(Continued)

*Primary Examiner* — Pegeman Karimi
(74) *Attorney, Agent, or Firm* — Morgan, Lewis & Bockius LLP

(57) ABSTRACT

In order to reduce non-uniform luminance and/or chrominance, a display panel can determine, on a pixel-by-pixel basis in at least a row of pixels, a correction for voltage drops in the display panel. The voltage drop can be estimated based on a state of pixels in the display panel corresponding to at least a portion of a current frame of image data and at least a portion of a previous frame of image data. Moreover, based on the correction, the display plane can modify on the pixel-by-pixel basis in at least the row: a supply voltage applied to the display panel; a digital representation of the image data in the current frame that correspond to the pixels; and pixel drive signals corresponding to the image data in the current frame. Furthermore, the correction may be based on a predefined calibration constant and/or may be dynamically calculated.

19 Claims, 15 Drawing Sheets

(56) References Cited

U.S. PATENT DOCUMENTS

| | | | | |
|---|---|---|---|---|
| 2008/0122816 | A1* | 5/2008 | Park | G09G 3/3648 345/204 |
| 2013/0194199 | A1* | 8/2013 | Lynch | G06F 3/0412 345/173 |
| 2014/0111655 | A1 | 4/2014 | Hwang | |
| 2015/0090988 | A1* | 4/2015 | Oooka | H01L 51/5228 257/40 |
| 2016/0086537 | A1 | 3/2016 | Shin | |

* cited by examiner

LUMINANCE UNIFORMITY CORRECTION FOR DISPLAY PANELS

CROSS REFERENCE TO RELATED APPLICATIONS

This application claims priority under 35 U.S.C. 120 as a Continuation-in-Part Patent Application of U.S. patent application Ser. No. 15/064,230, "Luminance Uniformity Correction for Display Panels," filed on Mar. 8, 2016 that, in turn, claims priority from U.S. Provisional Patent Application No. 62/146,185 filed Apr. 10, 2015, the contents of each of which is herein incorporated by reference.

FIELD

The described embodiments relate generally to display panels. More particularly, the present embodiments relate to systems, methods, and apparatus for reducing non-uniform luminance occurring at an organic light emitting diode (OLED) display panel.

BACKGROUND

The resolution of many display panels has rapidly increased in recent times due to advances in fabrication and light emitting diode (LED) technology. These advances have led to the introduction of thin form factor displays that cover large surface areas. However, because pixel density in many of larger displays has also increased, readily charging each pixel to accurately display image data has become an increasing issue. For example, in larger displays where currents must be transmitted rapidly over supply lines, many pixels are inadequately charged due to the voltage drops that can occur across the supply lines. As a result, the luminance across the display panel can appear less uniform thereby degrading the user experience.

SUMMARY

Some embodiments that relate to a display panel that corrects for voltage drops are described. In particular, the display panel includes: a pixel array with pixels arranged in rows; and a display driver. During operation, the display driver tracks a state of the pixels, where the state is based on at least a portion of a current frame of image data displayed in the pixel array and at least a portion of a previous frame of image data displayed in the pixel array. Then, the display driver determines a correction on a pixel-by-pixel basis in at least a row based on voltage drops in the pixel array. Moreover, based on the correction, the display driver modifies, on the pixel-by-pixel basis in at least the row, at least one of: a supply voltage applied to the pixel array; a digital representation of the image data in the current frame that correspond to the pixels; and pixel drive signals corresponding to the image data in the current frame. Furthermore, the display panel provides the pixel drive signals to at least the row.

Note that the correction may correspond to at least one of: a luminance error; and a chrominance error.

Moreover, the digital representation of the image data may be modified by changing gamma values on a pixel-by-pixel basis in at least the row.

Furthermore, the pixel array may include organic light emitting diodes (OLEDs).

Additionally, the correction may be determined based at least on: a location in the pixel array; a geometry of the pixel array; and physical parameters of the pixel array. In some embodiments, the correction is determined based at least on: a scan direction during refresh of the pixel array; and/or a temperature of the pixel array.

Moreover, the correction may be determined by calculating the voltage drops based on current in the pixel array. For example, the correction may be determined using a one-dimensional calculation or a two-dimensional calculation.

Furthermore, the correction may be determined based on a predefined calibration constant corresponding to variation in luminance and/or chrominance across the pixel array.

Other embodiments provide a display panel that corrects for skew associated with parasitic effects of signal lines.

Other embodiments provide the display driver for use with the display panel.

Other embodiments provide a graphics processing unit that performs at least some of the operations performed by the display driver.

Other embodiments provide a method for correcting for voltage drops. The method includes at least some of the aforementioned operations performed by the display driver, the display panel or the graphics processing unit.

Other embodiments provide a computer-program product for use with the display driver, the display panel or the graphics processing unit. This computer-program product includes instructions for at least some of the aforementioned operations performed by the display driver, the display panel or the graphics processing unit.

This Summary is provided for purposes of illustrating some exemplary embodiments, so as to provide a basic understanding of some aspects of the subject matter described herein. Accordingly, it will be appreciated that the above-described features are only examples and should not be construed to narrow the scope or spirit of the subject matter described herein in any way. Other features, aspects, and advantages of the subject matter described herein will become apparent from the following Detailed Description, Figures, and Claims.

BRIEF DESCRIPTION OF THE DRAWINGS

The included drawings are for illustrative purposes and serve only to provide examples of possible structures and arrangements for the disclosed systems and techniques for intelligently and efficiently managing communication between multiple associated user devices. These drawings in no way limit any changes in form and detail that may be made to the embodiments by one skilled in the art without departing from the spirit and scope of the embodiments. The embodiments will be readily understood by the following detailed description in conjunction with the accompanying drawings, wherein like reference numerals designate like structural elements.

Note that like reference numerals refer to corresponding parts throughout the drawings. Moreover, multiple instances of the same part are designated by a common prefix separated from an instance number by a dash.

DETAILED DESCRIPTION

Figure 1A:
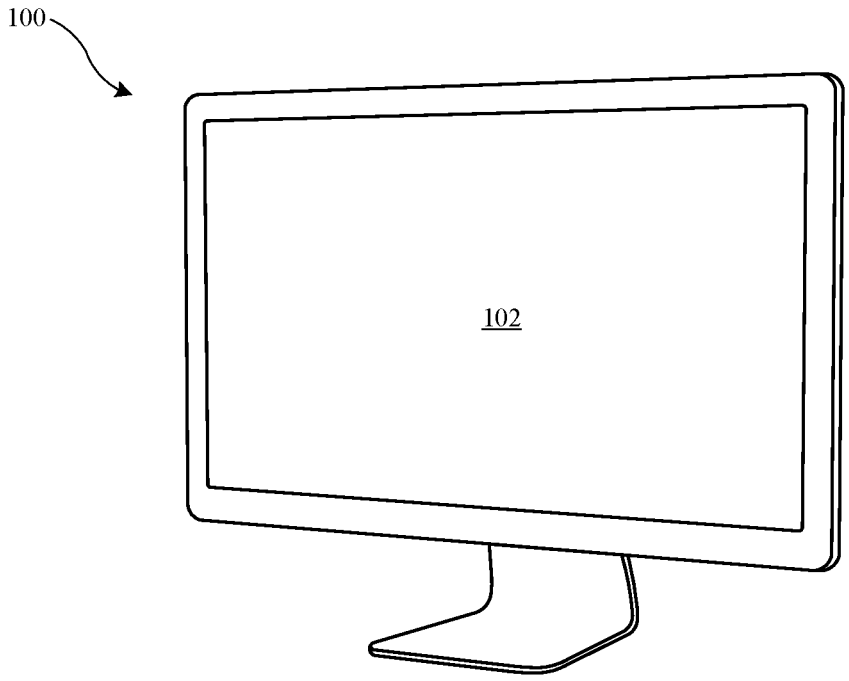
FIGS. 1A and 1B illustrate perspective views of an organic light emitting diode (OLED) display panel and a portion of an OLED matrix for the OLED display panel.

In order to reduce non-uniform luminance and/or chrominance, a display panel can determine, on a pixel-by-pixel basis in at least a row of pixels, a correction for voltage drops in the display panel. The voltage drop can be estimated based on a state of pixels in the display panel corresponding to at least a portion of a current frame of image data and at least a portion of a previous frame of image data. Moreover, based on the correction, the display plane can modify on the pixel-by-pixel basis in at least the row: a supply voltage applied to the display panel; a digital representation of the image data in the current frame that correspond to the pixels; and pixel drive signals corresponding to the image data in the current frame. Furthermore, the correction may be based on a predefined calibration constant and/or may be dynamically calculated.

By correcting for the voltage drops, this display technique may ensure a consistent viewing experience when users view the same content on different displays or different types of displays. Consequently, the display technique may improve the user experiencing when using displays that include the display panel.

Representative applications of methods and apparatus according to the present application are described in this section. These examples are being provided solely to add context and aid in the understanding of the described embodiments. It will thus be apparent to one skilled in the art that the described embodiments may be practiced without some or all of these specific details. In other instances, well known process operations have not been described in detail in order to avoid unnecessarily obscuring the described embodiments. Other applications are possible, such that the following examples should not be taken as limiting.

In the following detailed description, references are made to the accompanying drawings, which form a part of the description and in which are shown, by way of illustration, specific embodiments in accordance with the described embodiments. Although these embodiments are described in sufficient detail to enable one skilled in the art to practice the described embodiments, it is understood that these examples are not limiting; such that other embodiments may be used, and changes may be made without departing from the spirit and scope of the described embodiments.

Display panels have become more advanced since the inception of light emitting diodes (LEDs), which have allowed for the design of very thin and vibrant display panels. Certain display panels have incorporated organic LEDs (OLEDs), which have allowed for the design of larger and more energy efficient display panels. Although OLED display panels provide many benefits over previous LED display panels, the circuitry inherently required to distribute current within a high resolution OLED display can prove inadequate in some designs where current is limited. For example, in high-resolution OLED displays where there are a large number of supply lines and pixels supply lines, non-uniformities in luminance of the OLED display can occur due to voltage drops across the supply lines. As a result, pixels that are further from a display driver than other pixels in a given supply line may not receive adequate charge when illuminating. As a result, luminance in certain portions of the OLED display panel can appear non-uniform compared to other portions of the OLED display panel. In order to resolve the issue of non-uniformity, a current or voltage provided to each supply line or pixel can be compensated using a luminance correction factor. The luminance correction factor can be based at least in part on the expected amount of current consumed by other supply lines and/or pixels, and one or more calibration constants, as further discussed herein.

The calibration constants used to calculate an amount of current or voltage compensation for each supply line and/or pixel can be determined during an initial calibration of an OLED display. During the initial calibration, the OLED display panel can output one or more predetermined display patterns. Thereafter, the luminance of the OLED display at one or more measurement points can be measured and used to calculate a luminance error. The luminance error is a value corresponding to a difference in the measured luminance and an expected luminance for a measurement point. For example, when the OLED display is outputting an all-white pattern, each pixel in the OLED display should ideally receive an equal amount of voltage or current corresponding to the expected luminance. However, because of the depletion of charge or voltage that occurs at the capacitors of each supply line and the number of pixels in each supply line, current will vary linearly across a supply line and the voltage will vary non-linearly across the supply line, leading to an inadequate charging of pixels. Additionally, the current consumption of other supply lines can affect the voltage drop of a supply line because on the interconnectivity of each supply line in the OLED display, further exacerbating the issue of non-uniformity.

During calibration, once the measured luminance at the measurement point is found, the luminance error can be calculated in order to derive a calibration constant for one or more supply lines or pixels corresponding to the one or more measurement points. For example, the measured luminance at the measurement point can be compared to the expected luminance at the measurement point in order to derive the luminance error. The expected luminance can be determined from an amount of current that is designated for a pixel when displaying a predetermined display pattern during the calibration. Therefore, a pixel at the end of a first supply line can be designated to receive a current $i_D$, which is approximately proportional to the expected luminance of the pixel when the pixel is receiving the current $i_D$. If the expected luminance does not correspond to or substantially equal the measured luminance, the calibration constant can be calculated to account for the disparity between the expected luminance and the measured luminance. The amount of compensation created by the calibration constant can depend on a supply line (i.e., a row line or a column line) number corresponding to a location of a supply line within a sequence of supply lines, and/or the location of a pixel to be compensated within a supply line. Therefore, a unique calibration constant can be calculated for each sub-pixel, pixel, pixel color, group of pixels, and/or supply line in order to improve the uniformity of luminance for the entire OLED display panel. Additionally, a single calibration constant can be derived for the entire OLED display panel in order to improve the uniformity of luminance for the entire OLED display.

During operation of the display panel, a luminance correction factor can be calculated based on image data and one or more calibration constants. The luminance correction factor can be a product of the calibration constant, an expected pixel luminance, and an expected voltage drop of one or more supply lines or pixels. The expected voltage drop of the one or more supply lines or pixels can be calculated based on the image data. Therefore, because luminance is approximately proportional to the current provided to a pixel, the image data can be converted into current values for calculating the luminance correction factor in real time during operation of the OLED display. For example, when image or frame data is provided to a graphics memory connected to the OLED display, preprocessing of the image data can be performed. Thereafter, the image data can be converted into serial data that is scanned out on a per pixel basis and used to calculate the luminance correction factor. The luminance correction factor can be calculated on a per pixel or supply line basis using the calibration constant for each pixel or supply line and the expected voltage drop for a pixel or supply line, and optionally a total current for all pixels. The luminance correction factor can thereafter be converted to a current, voltage, or other signal that is used to modify the current or voltage provided to one or more pixels or supply lines of a display panel. In this way, luminance uniformity can be substantially improved using one or more calibration constants previously calculated for use by an OLED display. In some embodiments, a second order correction process is used to further improve luminance uniformity. The second order correction process uses the calculation of the luminance error previously discussed and adds, to the luminance error, a second order correction factor. The second order correction uses the square of a voltage drop for one or more rows or pixels. In this way, any growth in luminance error can be curbed by the second order correction factor in order to further promote uniform luminance across the display panel.

These and other embodiments are discussed below with reference to FIGS. 1-15; however, those skilled in the art will readily appreciate that the detailed description given herein with respect to these Figures is for explanatory purposes only and should not be construed as limiting.

Figure 1B:
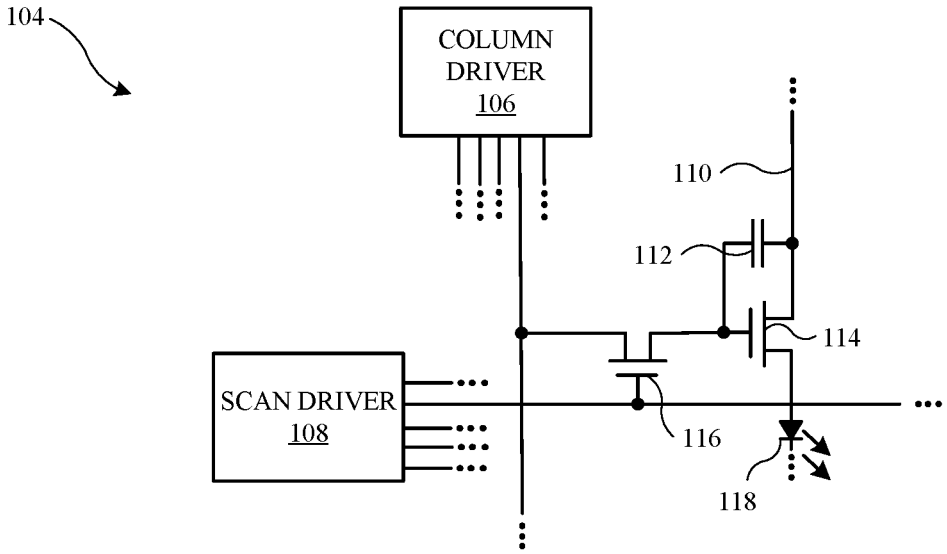

FIGS. 1A and 1B illustrate perspective views 100 of a simplified circuit of an organic light emitting diode (OLED) display panel 102 and an OLED array 104. The OLED display panel 102 can be a display panel using an OLED array 104 to output light at the OLED display panel 102. It should be noted that the term display panel as used herein can refer to the display of a laptop computing device, desktop computing device, media player, cellular phone, television, or any other electronic device incorporating a display having LEDs and/or OLEDs. FIG. 1B illustrates an OLED array 104 for use in the OLED display panel 102, or any other suitable display device. However, it should be noted that FIG. 1B is merely provided as an example of an LED circuit for a display panel and should not be viewed a limiting the scope of the disclosure. Therefore, any of the embodiments discussed herein can be applied to any suitable LED circuit arrangement in order to improve luminance uniformity at a display panel.

The OLED array 104 of FIG. 1B can include any suitable number of OLEDs 118, but for simplicity, a single OLED 118 is illustrated. Each OLED 118 can receive a supply signal from a column driver 106 and a supply line 110. During operation of the OLED array 104, a scan driver 108 can provide a signal to a gate of a first transistor 116, which allows for a signal to be provided from the column driver 106 to a gate of a second transistor 114. The second transistor 114 can be coupled to a capacitor 112 that is charged by the supply line 110 and provides a charge for the OLED 118. The OLED 118 will receive the charge from the capacitor 112 when the first transistor 116 closes as a result of receiving signals from the scan driver 108 and the column driver 106. Thereafter, the second transistor 114 will close as a result of the column driver 106 and the scan driver 108 providing signals to the first transistor 116, and the supply line 110 providing a signal to the second transistor 114. The signal from the column driver 106 and the charge from the capacitor 112 will pass through the closed second transistor 114 thereby causing the OLED 118 to illuminate. The OLED 118 can illuminate even after the signal from the scan driver 108 and/or the column driver 106 have terminated their respective signal because of the charge stored by the capacitor 112. Unfortunately, in OLED display panels having numerous OLEDs 118, the amount of charge available to each OLED 118 can be depleted more quickly based on a distance the OLED 118 is from the column driver 106 and/or the scan driver 108. In order to compensate for the charge or voltage depletion of the capacitors 112, the column driver 106 can be programmed to compensate the signal provided to the OLED 118 based on image data received by the OLED display panel 102. The compensation can further be based on a calibration constant that is based on a calibration of the display panel 102. In some embodiments, the charge depletion can be mitigated in by reprocessing the image data to compensate for an expected amount of voltage drop that will occur at the OLED display panel 102, at one or more supply lines of the OLED display panel 102, and/or at one or more OLEDs or pixels of the OLED display panel 102.

Figure 2:
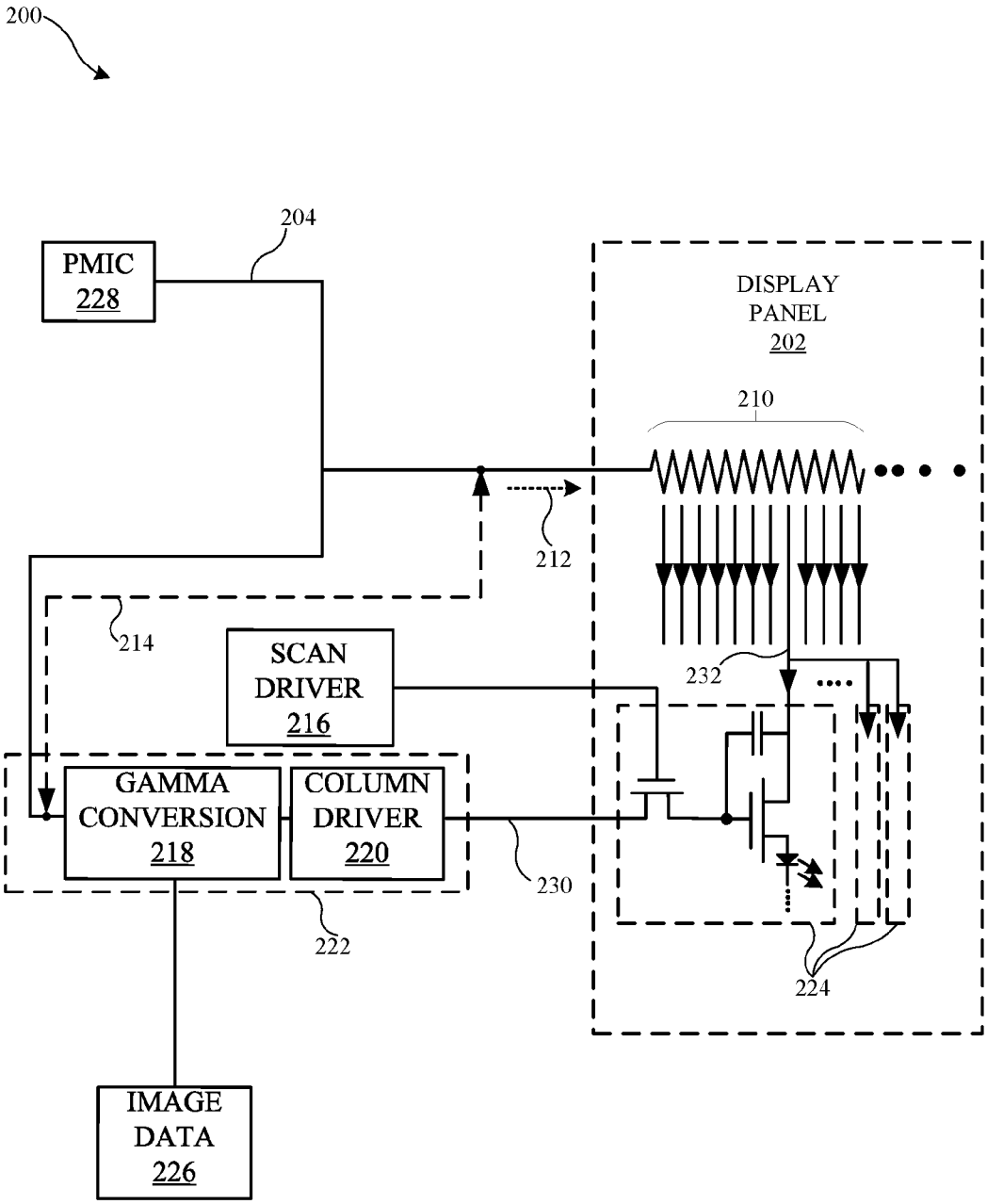
FIG. 2 illustrates a system diagram of a display panel that is configured to compensate for voltage drops across one or more supply lines of the display panel.

FIG. 2 illustrates a system diagram 200 of a display panel 202 that is configured to compensate for voltage drops across a column line 230 and/or a row line 232. The display panel 202 can be connected to a power management integrated circuit (PMIC) 228, which provides a supply voltage 204 for the display panel 202. A scan driver 216 and a column driver 220 are provided to supply a charge for each pixel circuit 224 in order to effectively illuminate each pixel of the display panel 202. The column driver 220 is part of an organic light emitting diode (OLED) driver 222, which can include a gamma conversion module 218. The gamma conversion module 218 can receive image data (e.g., compressed RGB (red, green, blue) domain data) from an image data module 226 and convert the image data into linear luminance domain data. The OLED driver 222 can be programmed to compensate for a voltage drop in the reference voltage 214 caused by a line resistance 210 in the display panel 202. (Thus, OLED driver 222 may include a correction circuit.) Compensating for the voltage drop ensures that an adequate source current 212 is provided to each row line 232 and/or column line 230 and that uniform luminance is projected across the display panel 202. Programming the OLED driver 222 to compensate for the voltage drop can be initiated during manufacturing when a calibration constant is generated for the display panel 202, as further discussed herein.

Figure 3A:
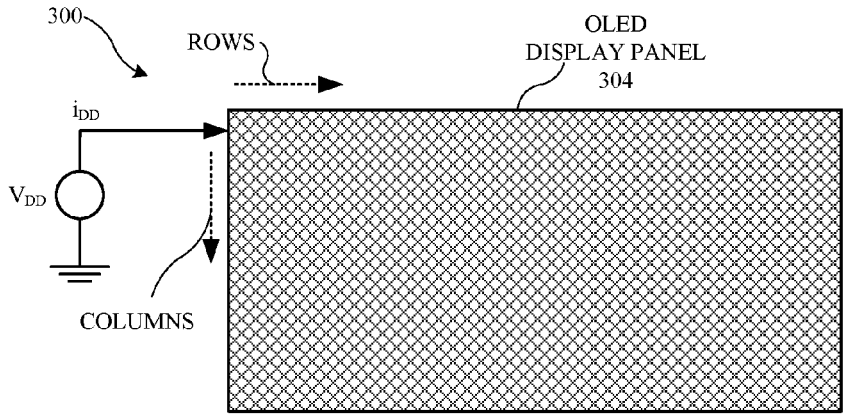
FIG. 3A illustrates techniques for calibrating an organic light emitting diode (OLED) display panel.

FIGS. 3A illustrates a technique for calibrating an OLED display panel 308. Specifically, FIG. 3A illustrates a system diagram 300 of a display panel section 306 that is receiving a source current, $i_{DD}$, from a voltage source $v_{DD}$. The source current is applied across one or more supply lines of the display panel section 306 in order to cause the display panel section 306 to illuminate according to a predetermined display pattern. During calibration, a luminance measurement is taken at one or more different measurement points simultaneous to the predetermined display pattern being displayed at the OLED display panel 308. A measurement of luminance can thereafter be used to determine a calibration constant. For example, the measurement of luminance can be compared to an expected amount of luminance in order to estimate the amount of voltage drop occurring across the OLED display panel 308. The voltage drop can thereafter be used to derive a suitable calibration constant that can be stored by the OLED display panel 308 and used to improve luminance uniformity during later operations of the OLED display panel 308. The OLED display panel 308 can store one or more calibration constants that each correspond to a portion of the OLED display panel 308, one or more supply lines of the OLED display panel 308, and/or one or more pixels of the OLED display panel 308.

In some embodiments, the calibration of the OLED display panel 308 is performed by using a predetermined display pattern that is configured to cause the first and last row of the OLED display panel 308 to illuminate. In other embodiments, the calibration of the OLED display panel 308 is performed by taking multiple measurements of luminance across the OLED display panel 308 when the OLED display panel 308 is display one or more predetermined display patterns. In yet other embodiments, calibration of the OLED display panel 308 is performed by taking one or more measurements of luminance of the OLED display panel 308 when the OLED display panel 308 is a solid white display pattern. Furthermore, calibration of the OLED display panel 308 can be performed by measuring luminance of the OLED display panel 308 when the OLED display panel 308 is outputting one or more solid white image, solid red images, solid green images, and/or solid blue images, and/or any combination thereof. In this way, a calibration constant can be calculated for each of the one or more solid white images, the solid red images, the solid green images, and/or the solid blue images. Thereafter, one or more of the calibration constants can be used to compensate a signal for charging one or more red pixels, green pixels, and/or blue pixels. Furthermore, one or more weighting factors can be stored and used to further compensate signals provided to different colored pixels based on how each of the different colored pixels affect each other during operations. These weighting factors can be derived during any of the calibration methods discussed herein. Additionally, the weighting factors, as well as the calibration constants, can be based upon the material makeup of each of the red pixel, green pixel, and blue pixel.

Figure 3B:
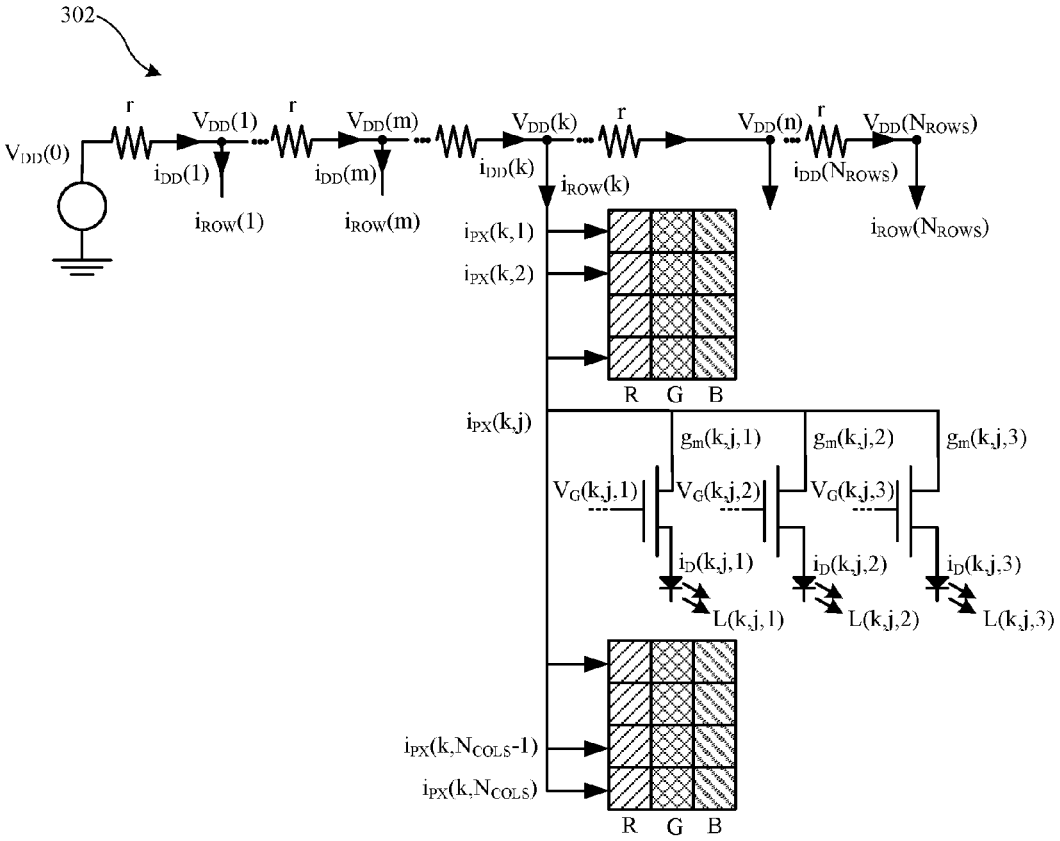
FIG. 3B illustrates a circuit diagram of a portion of an OLED display circuit.

FIG. 3B illustrates a simplified diagram 302 of the connectivity of pixels to a supply line of the OLED display panel 308. The simplified diagram 302 can be used to understand how current and voltage is distributed through the OLED display panel 308, as well as how expected luminance and measured luminance can be compared to determine voltage drop for a given supply line or pixel. Expected luminance can be calculated from a pixel current according to Equation (1) below, where $\eta_C$ is a diode efficiency constant that is constant for a particular diode and/or panel technology.

$$i_D(k, j, h) = \frac{L(k, j, h)}{\eta_C} \tag{1}$$

Equation (1) can be used to determine an expected luminance for a predetermined display pattern. For example, a predetermined pixel current will be provided to a pixel in the display panel section 306 for any given predetermined display pattern. The pixel can be any one of the sub-pixels corresponding to $i_D(k,j, 1)$, $i_D(k,j, 2)$ and/or $i_D(k,j, 3)$ of FIG. 3B. In order to determine the voltage drop during calibration, a sum of currents used to illuminate a portion of the display, such as display panel section 306, is calculated. For example, a sum of individual pixel currents corresponding to a group of pixels (i.e., red (R), green (G), and blue (B)) is calculated according to Equation (2) below, which references the pixels currents of FIG. 3B.

$$i_{PX}(k, j) = \sum_{h=1}^{3} i_D(k, j, h) \tag{2}$$

Next, a sum of the pixel currents for a single supply line is calculated by summing all of the pixel currents corresponding to each group of pixels in a supply line. The sum of pixel currents for a single supply line (i.e., a row line or a column line) can be calculated according to Equation (3) below.

$$i_{ROW}(k) = \sum_{j=1}^{N_{COLS}} i_{PX}(k, j) \tag{3}$$

Next, supply line currents corresponding to the voltage drop summed according to Equation (4) below. The summation of these supply line currents represents the total amount of current used to illuminate the OLED display panel 308 and can be used to calculate an expected voltage drop.

$$i_{DD}(m) = \sum_{k=m}^{N_{ROWS}} i_{ROW}(k) \tag{4}$$

In order to calculate the expected voltage drop, a resistance r corresponding to the resistance between each supply line, as illustrated in FIG. 3B, is multiplied by the sum of the supply line currents calculated in Equation (4). The resulting product is thereafter subtracted from the initial voltage $V_{DD}(0)$ illustrated in FIG. 3B and as provided in Equation (5) below, where m is a supply line number and n is a supply line number corresponding to the supply line for which a voltage drop is being calculated.

$$v_{DD}(n) = v_{DD}(0) - r\sum_{m=1}^{n} i_{DD}(m) \quad (5)$$

In order to determine a calibration constant for each supply line, group of pixels, and/or individual pixels, a change in expected voltage drop $v_{DD}(n)$ can be converted to an expected change in luminance according to Equation (6). In Equation (6), $\eta_C$ is a diode efficiency constant and $g_m$ is defined by Equation (7), where $K_p$ is a transconductance parameter of a transistor in the display panel section 306 and $i_D$ is the pixel current.

$$\Delta L(n,j,h)=\eta_C g_m \Delta v_{DD} \quad (6)$$

$$g_m=\sqrt{2K_p i_D} \quad (7)$$

Once an expected change in luminance for a supply line, group of pixels, and/or individual pixel is calculated, the expected change in luminance can be compared to the measured luminance that is taken during the calibration. Because the expected change in luminance is based on essentially pixel data that is converted into pixel currents that are summed for a given display panel section 306, the expected change in luminance is an estimated or ideal change in luminance. This expected change in luminance can be compared to the measured luminance of one or more portions of the display panel section 306. In some embodiments, during calibration, portions of a display panel can be sequentially illuminated and measured according to a predetermined display pattern. For one or more sequences or iterations, a luminance value is measured and summed with any previously measured luminance values.

A measured voltage drop can be calculated according to Equation (8) set forth below, where n is a row number associated with the expected voltage drop and m is a starting row number (e.g., 1) for deriving $f_{SUM}(n)$. Because of the relationship between luminance and pixel current, the measured luminance can be converted into the measured voltage drop for purposes of determining one or more calibration constants.

$$f_{SUM}(n) = \sum_{m=1}^{n}\sum_{k=m+1}^{N_{ROWS}}\sum_{j=1}^{N_{COLS}}\sum_{h=1}^{3} L(k,\ j,\ h) \cong 3N_{COLS}\sum_{m}^{n}\sum_{k=m+1}^{N_{ROWS}} L_{ROW}(k) \quad (8)$$

During calibration, the measured voltage drop $f_{SUM}(n)$ for a row n, can be multiplied by a square root of a diode luminance and the resulting product can be used to calculate the calibration constant $C_{LUM}$ according to Equation (9) set forth below.

$$\Delta L(n,j,h)=C_{LUM}\sqrt{L(n,j,h)}f_{SUM}(n) \quad (9)$$

The resulting value for $C_{LUM}$ for one or more rows and/or pixels can thereafter be stored by a computer performing the calibration or by the display panel that is being calibrated. The display panel can store one or more calibration constants $C_{LUM}$ and associate each calibration constant with a row, a group of pixels, an individual pixel, and/or an entire display panel. In this way, the calibration constant $C_{LUM}$ can be used by the display panel to perform real time adjustments to a signal provided to one or more rows, columns, and/or supply lines of the display panel to improve luminance uniformity, as discussed herein.

Figure 4:
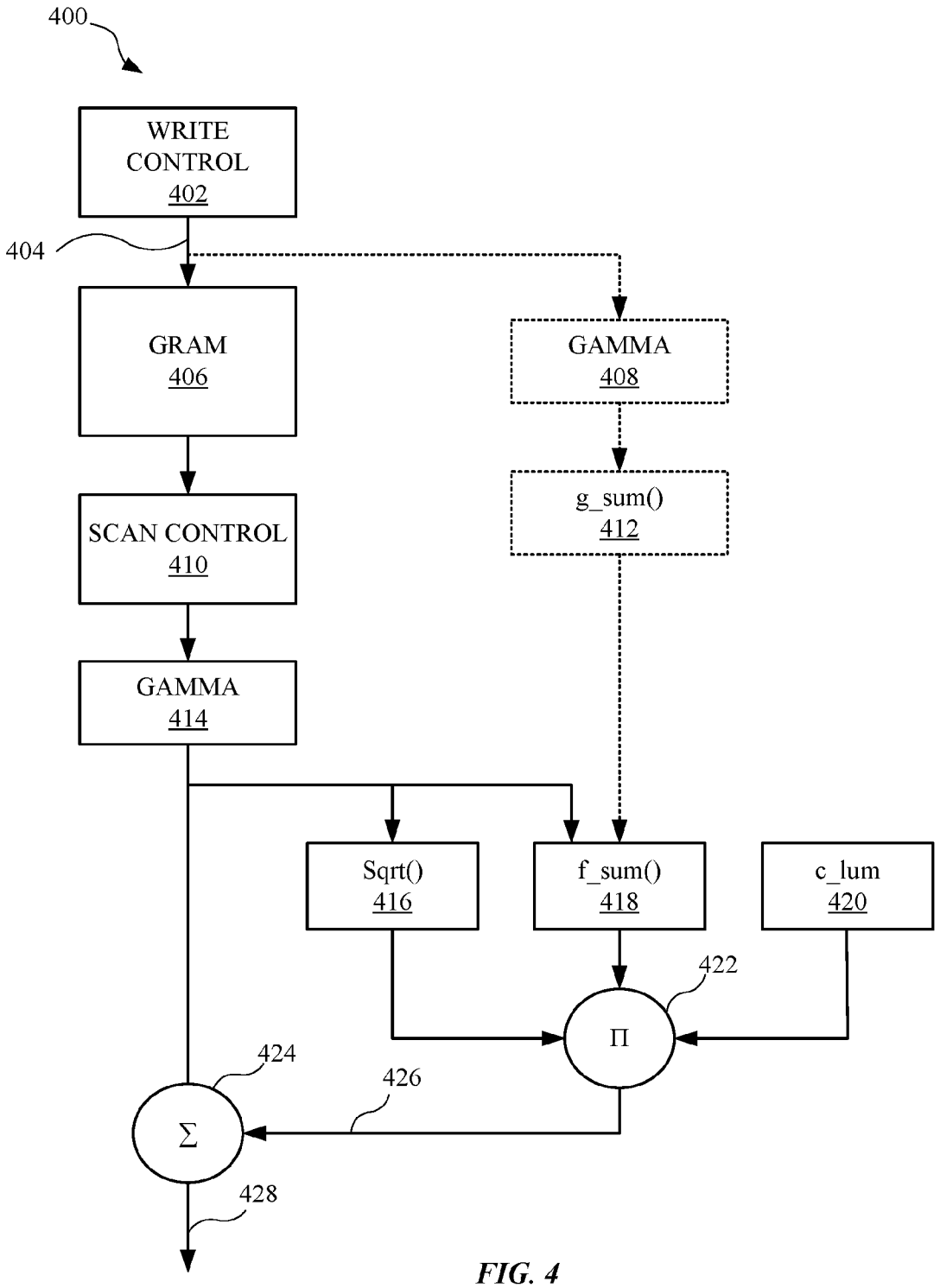
FIG. 4 illustrates a system for using a calibration constant to compensate a signal for an OLED display panel.

FIG. 4 illustrates a system 400 for using a calibration constant to compensate a drive signal for an OLED display panel. The system 400 can be embodied as software within a timing controller (TCON), row driver, column driver, gate driver, or any other suitable device for directly or indirectly controlling an amount of voltage or current that can be provided to a row or column of a display panel. The system 400 includes a write control 402 that can write image data 404 to a graphic random access memory (GRAM) 406. The image data 404 can also be provided to a separate portion of the system 400 responsible for calculating a total amount of current associated with the image data 404. For example, and optionally (as indicated by the dotted lines), the image data 404 can first be received by a gamma module 408 that modifies the image data 404 by converting the image data 404 into serial or linear image data. Next, the serial image data is provided to the g_sum( ) module 412, which calculates a total amount of current associated with the serial image data for all pixels of the display panel. Optionally, and in some embodiments, the total expected voltage drop for one or more rows can be calculated using the total current value ($g_{SUM}(N_{ROWS})$). Thereafter, the total supply voltage drop for one or more supply lines can be calculated by subtracting, from the total current for all display lines (i.e., $g_{SUM}(N_{ROWS})$), a total voltage drop for pixels other than those at the one or more supply lines n.

In FIG. 4, the image data 404 provided to the GRAM 406 can be sent to a scan control module 410 that can then provide the image data to the gamma module 414. However, in some embodiments, each of the gamma modules 408 and 414 are applied to the image data after the luminance correction factor 426 has been applied to the image data. The gamma module 414 can be configured to receive the image data 404 or a portion of the image data and convert the image data into a serial or linear form. The serial image data can thereafter be summed or otherwise combined with a luminance correction value 426 at a summation module 424. The resulting sum can provide image data that is adjusted to correct non-uniform luminance that can occur at a display panel connected to the system 400. The luminance correction value 426 is generated using a sqrt( ) value 416, an f_sum( ) value 418, and a c_lum value 420, as discussed herein. The sqrt( ) value 416 is a square root of a representation of an expected luminance value for one or more pixels that will receive the serial image data, as provided in Equation 9 herein. The f_sum value 418 is an expected voltage drop for one or more pixels, groups of pixels, or rows. This value can be calculated using the serial image data and Equation 8, as discussed herein. For example, during operation, the system 400 can use Equation 8 to calculate an expected voltage drop, the f_sum value 418, based on image data associated with one or more currents for one or more pixels or sub-pixels. Optionally, the f_sum value 418 can be calculated using a total current for all display lines of the display panel from the g_sum( ) module 412 as discussed herein.

The c_lum value 420 of system 400 can be one or more of the calibration constants discussed herein. The c_lum value 420 is multiplied by the resulting f_sum( ) value 418 and the sqrt( ) value 416 at the multiplier module 422. The resulting product from the multiplier module 422 is the luminance correction value 426, which can be added to the serial image data at the summation module 424. As a result, compensated serial image data 428 can be provided to one or more rows, columns, and/or supply lines of a display panel in order to reduce non-uniform luminance of the display panel.

It should be noted that although values for $f_{SUM}(n)$ are discussed herein as being calculated according to a one-dimensional variable such as row, column, and/or pixel, multidimensional variables can be used. For example, when calculating $f_{SUM}(n)$, a matrix value for n can be used in order to calculate $f_{SUM}(n)$ according to a two-dimensional variable. The matrix value for n can correspond to one or more rows, columns, and/or pixels of a display panel. In this way, calculations for representations of voltage drop (i.e., $f_{SUM}(n)$) and/or calculations for representations of total current for a display panel $g_{SUM}(N_{ROWS})$ can be calculated using two-dimensional variables. Furthermore, luminance error can be calculated as a one-dimensional variable or as a two-dimensional variable. For example, luminance error can be a matrix of the same or different values, and the luminance error matrix can be used to compensate one or more signals for one or more columns, rows, sub-pixels, and/or pixels of a display panel.

In some embodiments, a second order correction process is used to compensate a drive signal for an OLED display panel. For example, in order to reduce a linearization error that can occur when compensating a drive signal based on luminance error, a second order correction factor can be combined with the luminance error to reduce voltage drop. The second order correction factor can be calculated by squaring the c_lum value, dividing the squared c_lum value by 2, and thereafter multiplying the resulting value by a square of the f_sum( ) value. The resulting product is the second order correction factor, which can be combined with the serial image data to reduce non-uniform luminance that can occur at an OLED display panel.

Figure 5:
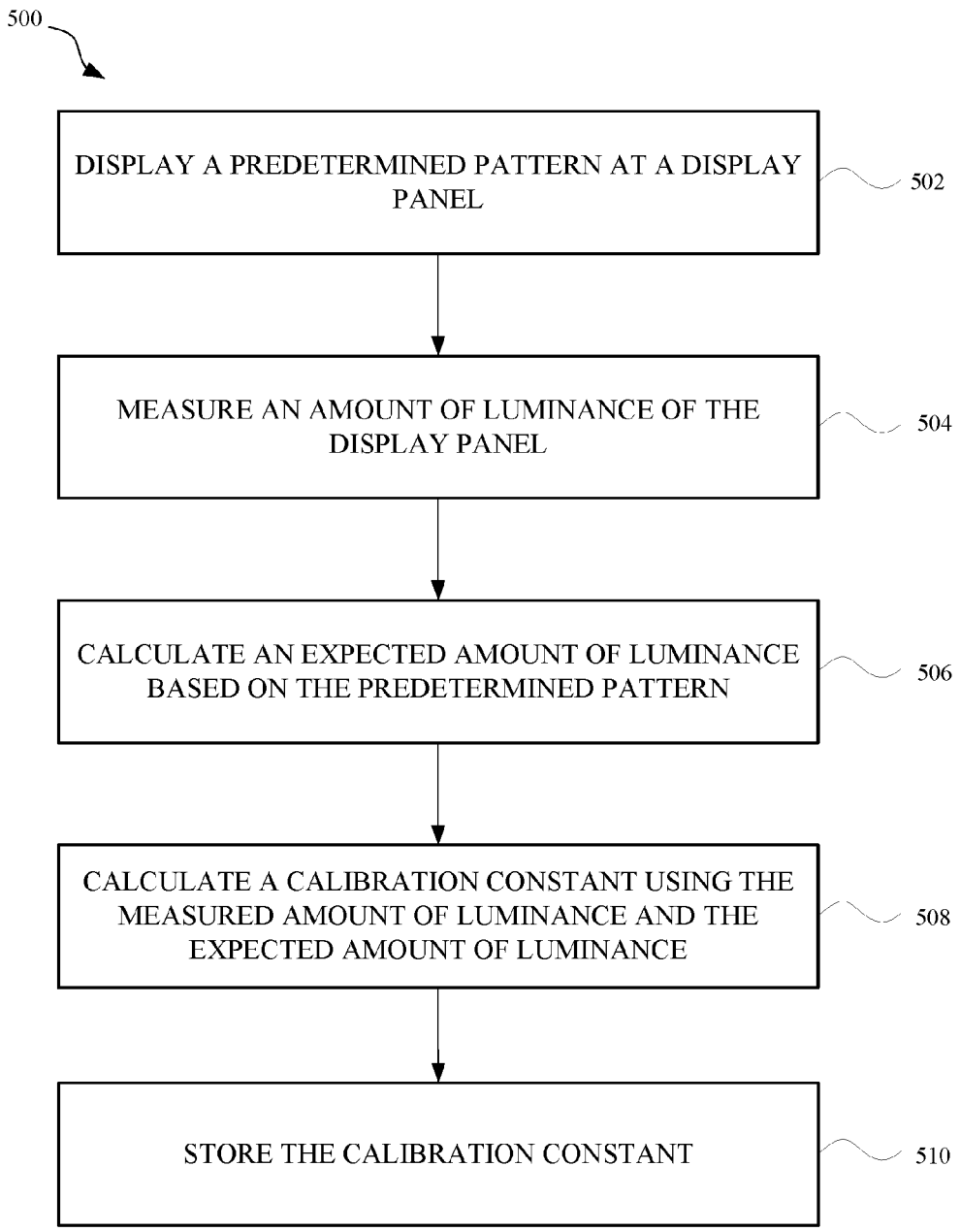
FIG. 5 illustrates a method for calculating one or more calibration constants for a display panel during a calibration of the display panel.

FIG. 5 illustrates a method 500 for calculating one or more calibration constants for a display panel during a calibration of the display panel. Method 500 can be performed by a computing device, a manufacturing device, and/or any suitable device for calibrating a display panel. Method 500 can include an operation 502 of displaying a predetermined pattern at a portion of a display panel. The predetermined pattern can be a solid color, a patterned image, a picture of varying luminance, or any other suitable pattern for calibrating a display panel. Method 500 can further include an operation 504 of measuring an amount of luminance at the portion of the display panel. The measurement of luminance can be performed by a camera, and the measured amount of luminance can be stored as a value of lumens or any other suitable metric for indicating brightness or intensity of light. Method 500 can further include an operation 506 of calculating an expected amount of luminance, or expected change in luminance from a previous iteration of Method 500, based on one or more currents associated with the predetermined pattern. As discussed herein, a predetermined display pattern can be associated with an amount of current that is to be provided to each pixel in a portion of the display panel, and the amount of current can be approximately proportional to an amount of luminance exhibited by the display panel. Therefore, by summing the current used for a particular display pattern and converting the sum to an amount of luminance, the expected amount of luminance or expected change in luminance can be derived. Method 500 can also include an operation 508 of calculating a calibration constant for the portion of the display panel using the measured amount of luminance and the expected amount of luminance as discussed herein. Additionally, method 500 can include an operation 510 of storing the calibration constant for the portion of the display panel and, optionally, continuing calibrating the display panel using a different portion of the display panel. The portion of the display panel can refer to a pixel, group of pixels, sub-pixel, a row, a group of rows, a column, and/or a group of columns. Therefore, a calibration constant can be calculated and associated with a pixel, sub-pixel, group of pixels, a row, a group of rows, a column, and/or a group of columns according to method 500 in order to improve luminance uniformity for the entire display panel.

Figure 6:
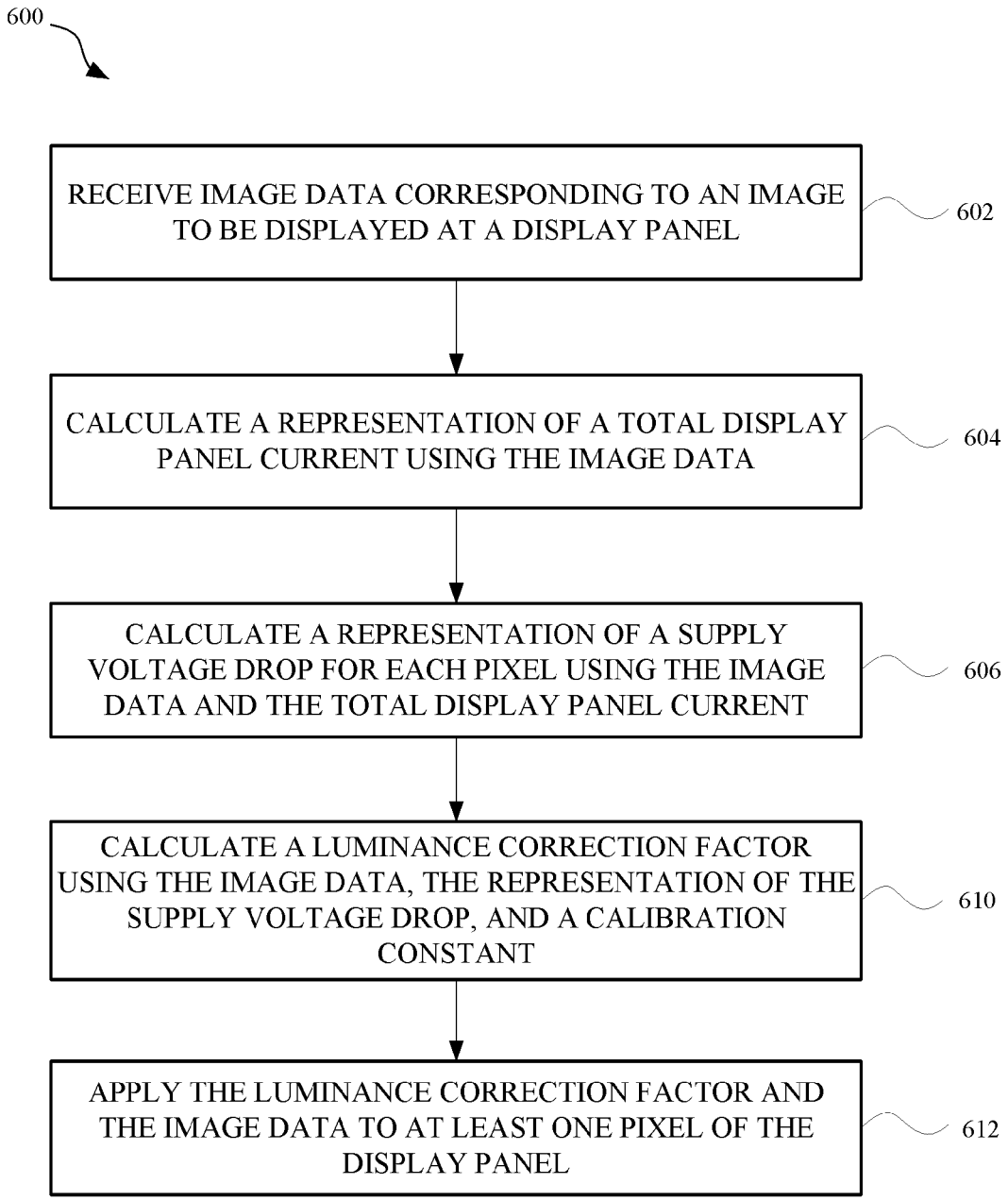
FIG. 6 illustrates a method for calculating a luminance correction factor and compensating a signal to a display panel based on the luminance correction factor in order to mitigate non-uniform luminance at the display panel.

FIG. 6 illustrates a method 600 for calculating a luminance correction value and compensating a signal to a display panel based on the luminance correction value in order to mitigate non-uniform luminance at the display panel. Method 600 can be performed by a processor, a display panel, a display driver, controller, a computing device connected to a display panel (such as graphical processing unit), a software module stored by a computing device, or any other suitable device for controlling a display panel. (Thus, in general, method 600 may be performed in hardware and/or software.) For example, method 600 can be embodied as software stored by a computing device connected to a display panel. In this way, the software can modify image data before the image data is provided to the display panel in order to reduce non-uniform luminance exhibited by the display panel. However, in some embodiments, method 600 is embodied as software stored by a display panel in order to modify image data after the image data is received by the display panel in order to reduce non-uniform luminance exhibited by the display panel. Method 600 can include an operation 602 of receiving image data corresponding to an image to be displayed at a display panel. However, in some embodiments, the image data received at operation 602 corresponds to multiple images that have been and/or are being processed by the display panel. Method 600 can further include an operation 604 of calculating a representation of a total display current using the image data. The representation of the total display current can be a current value or any other suitable metric for representing an amount of current. Additionally, method 600 can include an operation 604 of calculating a representation of a supply voltage drop for each pixel using the image data and the representation of the total display panel current. The representation of the supply voltage drop can be a voltage value or any other suitable metric for representing an amount of voltage drop. At operation 606, a luminance correction value or luminance error value is calculated using the image data, the representation of the supply voltage drop, and a calibration constant. At operation 612, the luminance correction value and the image data are applied to or otherwise provided to at least one pixel of the display panel. In this way, the image data can be modified according to the luminance correction value in order to mitigate any non-uniform luminance experienced by the display panel. As a result, a better user experience is provided while also making a more effective and efficient use of current at the display panel.

Figure 7:
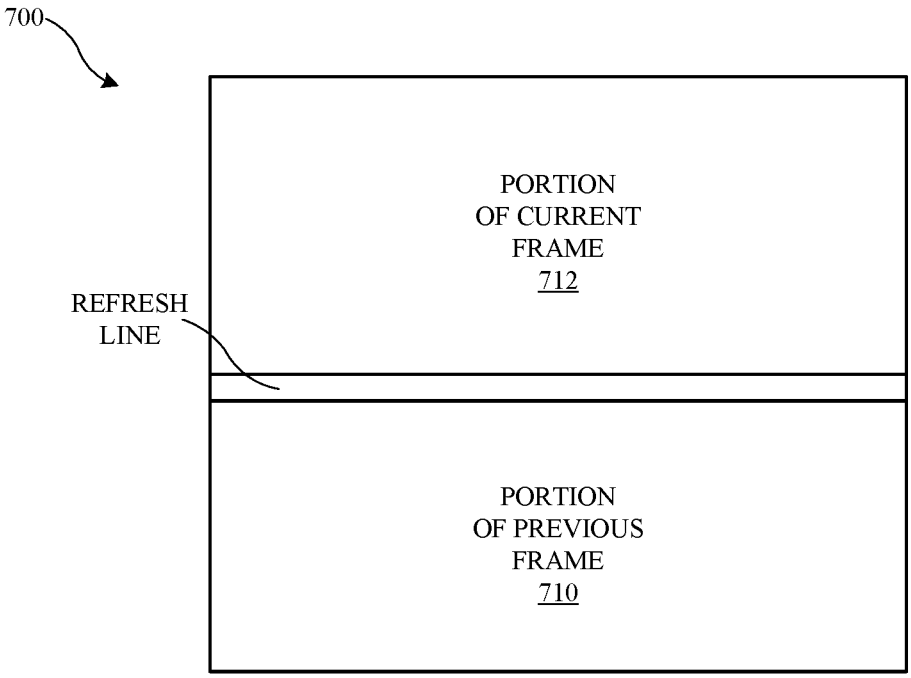
FIG. 7 illustrates a display panel that displays at least a portion of a previous frame of image data and at least a portion of a current frame of image data.

In general, the correction for the voltage drops in the display panel may depend upon the state of the display panel, i.e., the spatial pattern of pixels that are turned on or off. In general, the state of the display panel during refresh may depend on at least a portion of a previous frame of image data that is still displayed and at least a portion of a current frame of image data that is being displayed. Thus, the state of the display panel or the pixel array in the display panel may depend on a history of the image data that is displayed. This is illustrated in FIG. 7, which presents a drawing of a display panel 700 that displays at least a portion of a previous frame 710 of image data and at least a portion of a current frame 712 of image data.

Consequently, the display technique may account and correct for image-dependent losses in the display panel. In particular, the display technique may track and/or store the state of the display panel, and this information may be used to determine a correction for luminance and/or chrominance error that is caused by or that results from the voltage drops in the display panel.

Figure 8:
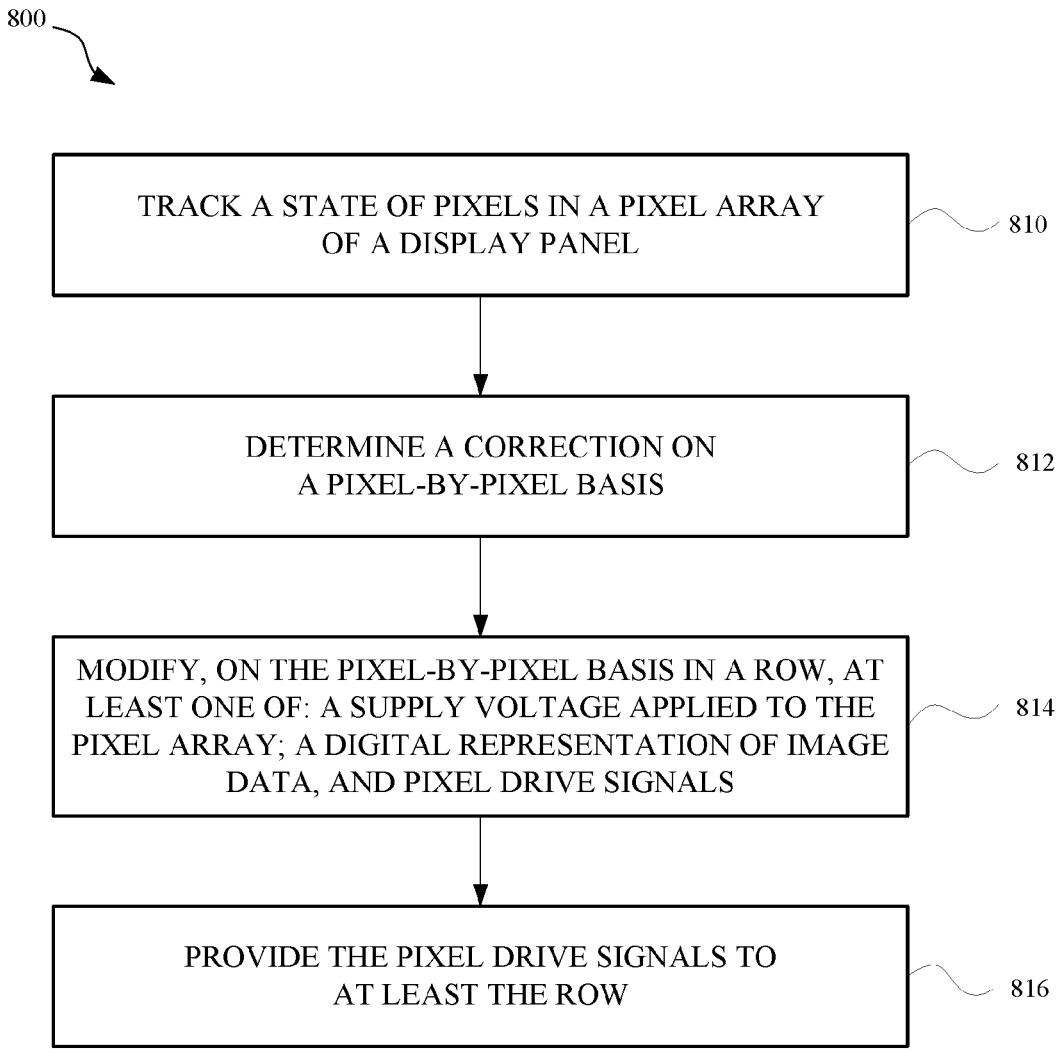
FIG. 8 illustrates a method for correcting for voltage drops in a display panel.

FIG. 8 illustrates a method 800 for correcting for voltage drops in a display panel. Method 800 can be performed by a processor, a display panel, a display driver, controller, a computing device connected to a display panel (such as graphical processing unit), a software module stored by a computing device, or any other suitable device for controlling a display panel. (Thus, in general, method 800 may be performed in hardware and/or software.) For example, method 800 can be embodied as software stored by a computing device connected to a display panel. In this way, the software can modify image data before the image data is provided to the display panel in order to reduce non-uniform luminance and/or chrominance exhibited by the display panel. However, in some embodiments, method 800 is embodied as software stored by a display panel in order to modify image data after the image data is received by the display panel in order to reduce non-uniform luminance and/or chrominance exhibited by the display panel. In the discussion that follows, a display driver is used as an illustrative example of a component that implements method 800.

During operation, the display driver tracks a state of the pixels (operation 810) in a pixel array in the display panel (such as an OLED display), where the state is based on at least a portion of a current frame of image data displayed in the pixel array and at least a portion of a previous frame of image data displayed in the pixel array.

Then, the display driver determines a correction on a pixel-by-pixel basis (operation 812) in at least a row of pixels based on voltage drops in the pixel array. Thus, the correction may be determined dynamically based on the state of the display panel or the pixel array as the display panel is refreshed.

Moreover, based on the correction, the display driver modifies (operation 814), on the pixel-by-pixel basis in at least the row, at least one of: a supply voltage applied to the pixel array; a digital representation of the image data in the current frame that correspond to the pixels; and pixel drive signals corresponding to the image data in the current frame. For example, the digital representation of the image data may be modified by changing gamma values on a pixel-by-pixel basis in at least the row. Note that the correction may correspond to at least one of: a luminance error; and a chrominance error. Thus, the correction may correct for an error in the luminance and/or the chrominance of the pixel array that is associated with DC voltage drops in the pixel array.

The correction may be determined based at least on: a location in the pixel array; a geometry of the pixel array (such as a geometry and/or an aspect ratio of the pixel array); and physical parameters of the pixel array (such as resistances). In some embodiments, the correction is determined based at least on a scan direction (such as top-to-bottom or left-to-right) during refresh of the pixel array. In general, the correction may depend on the location of a pixel relative to a supply voltage and how the state of the display panel is changed, i.e., the scan direction or the column drivers. Moreover, the correction may depend on a temperature of the pixel array (which may modify the physical parameters and, thus, the voltage drops). For example, a temperature sensor (such as a resistive temperature sensor, a diode, etc.) in or proximate to the display panel may determine or measure the temperature of the pixel array, and the temperature measurement may be used to modify the calculation of the correction. Alternatively or additionally, the correction may be determined based on a predefined calibration constant corresponding to variation in luminance and/or chrominance across the pixel array, which may be determined using a calibration technique (as described further below with reference to FIG. 14).

Furthermore, the display panel provides the pixel drive signals (operation 816) to at least the row.

In some embodiments of one or more of the preceding or subsequent methods, there may be additional or fewer operations. Moreover, the order of the operations may be changed, and/or two or more operations may be combined into a single operation. For example, while the preceding discussion illustrated method 800 as being determined on a pixel-by-pixel basis, in other embodiments the correction is determined based on a region or an area that includes multiple pixels, at the cost of a reduction in the resolution.

As noted previously, the display technique may determine the voltage drops by converting the measured or the estimated current consumption in the display panel (which is based on the state of the display panel) to a corresponding voltage. Then, the correction may be determined and applied in order to correct the luminance and/or the chrominance (in general, the correction is applied to greyscale and color) of the display panel. The correction may be applied in the analog and/or in the digital domain. For example, the correction may be applied, on a per-pixel basis, by modifying: a supply voltage applied to the display panel; a digital representation of the image data in the current frame that correspond to the pixels (such as by modifying gamma values for the pixels in the image data); and pixel drive signals corresponding to the image data in the current frame (which are sometimes referred to as 'drive-level voltages' or 'gate voltages'). Note that modifying the gamma values may impact the dynamic range.

For example, the correction may be determined using a one-dimensional calculation or a two-dimensional calculation (which may be needed depending on the aspect ratio of the pixel array). In particular, the transformation from pixel values (on or off) to the voltage drop may be determined using a linear model. These calculations may be facilitated using values of one or more physical parameters and/or one or more predefined calibration constant that are stored in memory in a look-up table. In addition, the state of the pixel array may be stored in memory. In some embodiments, the correction is determined by inverting a matrix that has a vector of pixel values (or currents) as an input.

Alternatively or additionally, in some embodiments the display panel (or an average display panel) may be calibrated during manufacturing. In particular, image data for a constant screen (white, red, green or blue) may be driven on the pixel array, and the distribution of luminance and/or chrominance across the pixel array may be measured using a camera (and, more generally, an imaging sensor). These operations may be repeated for primary colors because, in principle, each color may draw different currents for the same luminance. Note that these calibration tables may be used to determine the correction needed to correct for the luminance and/or the chrominance error associated with an arbitrary state of the pixel array.

In some embodiments, changing the gamma values in the analog domain (such as in the display driver) may provide more accurate adjustment without adversely impacting the dynamic range. Moreover, note that the voltage drops and the pixel driving voltages may be used to optimize the headroom margin. This additional degree of freedom may facilitate: a display panel with a high number of pixels per inch (which may have a routing resistance), a narrow bezel display panel (in which the pixel driving voltages or signals may have a lower driving strength), and/or a display panel with a high dynamic range.

Additional Embodiments

Figure 9:
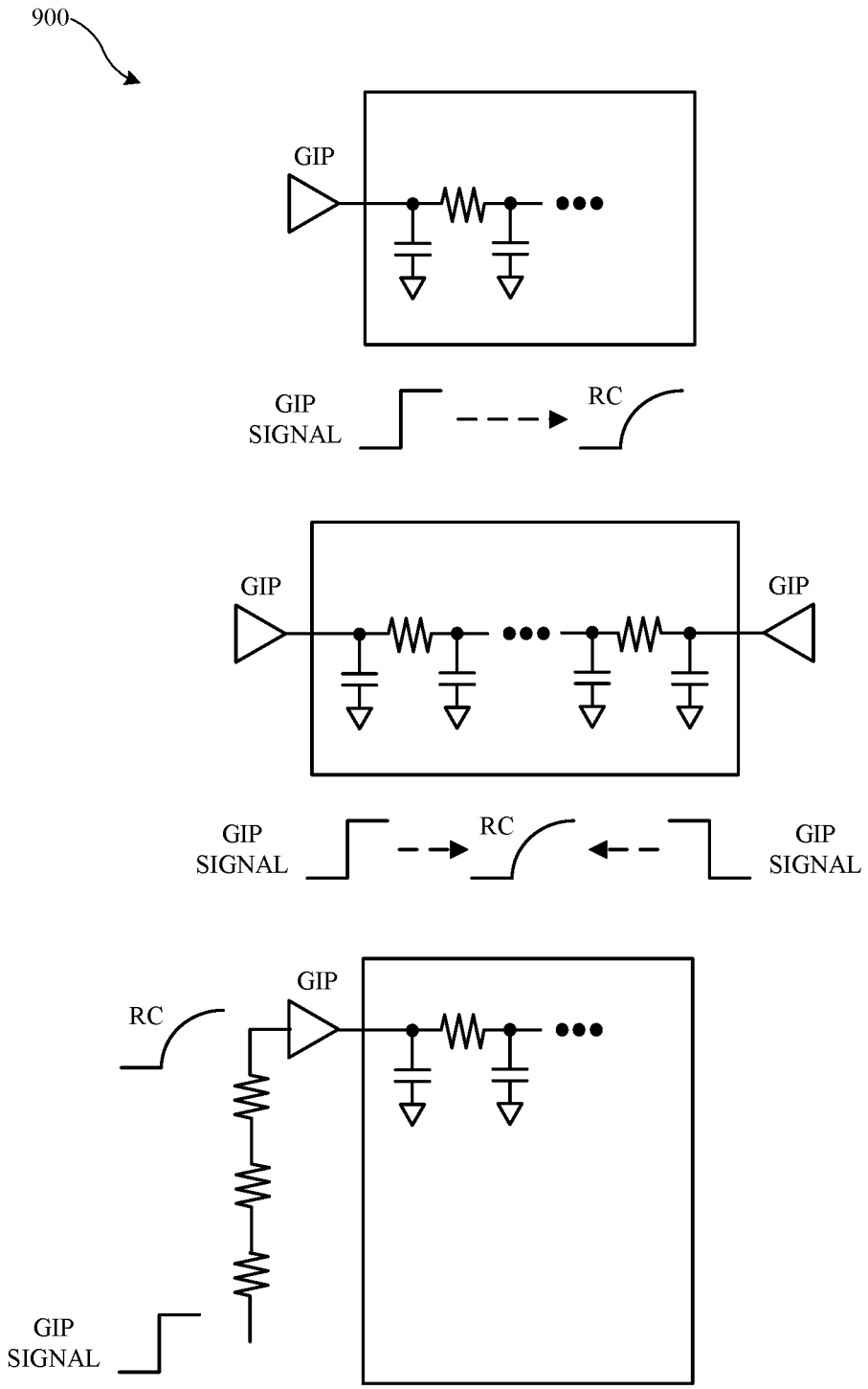
FIG. 9 illustrates skew in pixel drive signals driving display panels.

In some embodiments, instead of or in addition to correcting for the DC voltage drops described previously, the display technique is used to correct for skew in the pixel drive signals (such as gate-in-pixel or GIP signals). FIG. 9 illustrates skew in pixel drive signals driving display panels 900. In particular, the pixel drive signals may exhibit skew because of scan-line parasitic effects, which may adversely impact luminance and/or chrominance uniformity. Note that these skew effects may be worse in large-area display panels because of the long driving distance. Moreover, increases in the panel and/or flex-routing resistance may increase the sensitivity of the gate threshold voltage to scan-line load variations.

As shown in FIG. 9, skew can occur in the pixel drive signals in display panels that are driving single-sided and double-sided. Moreover, skew can occur in the pixel drive signals in the horizontal or row direction and/or in the vertical or column direction.

Figure 10:
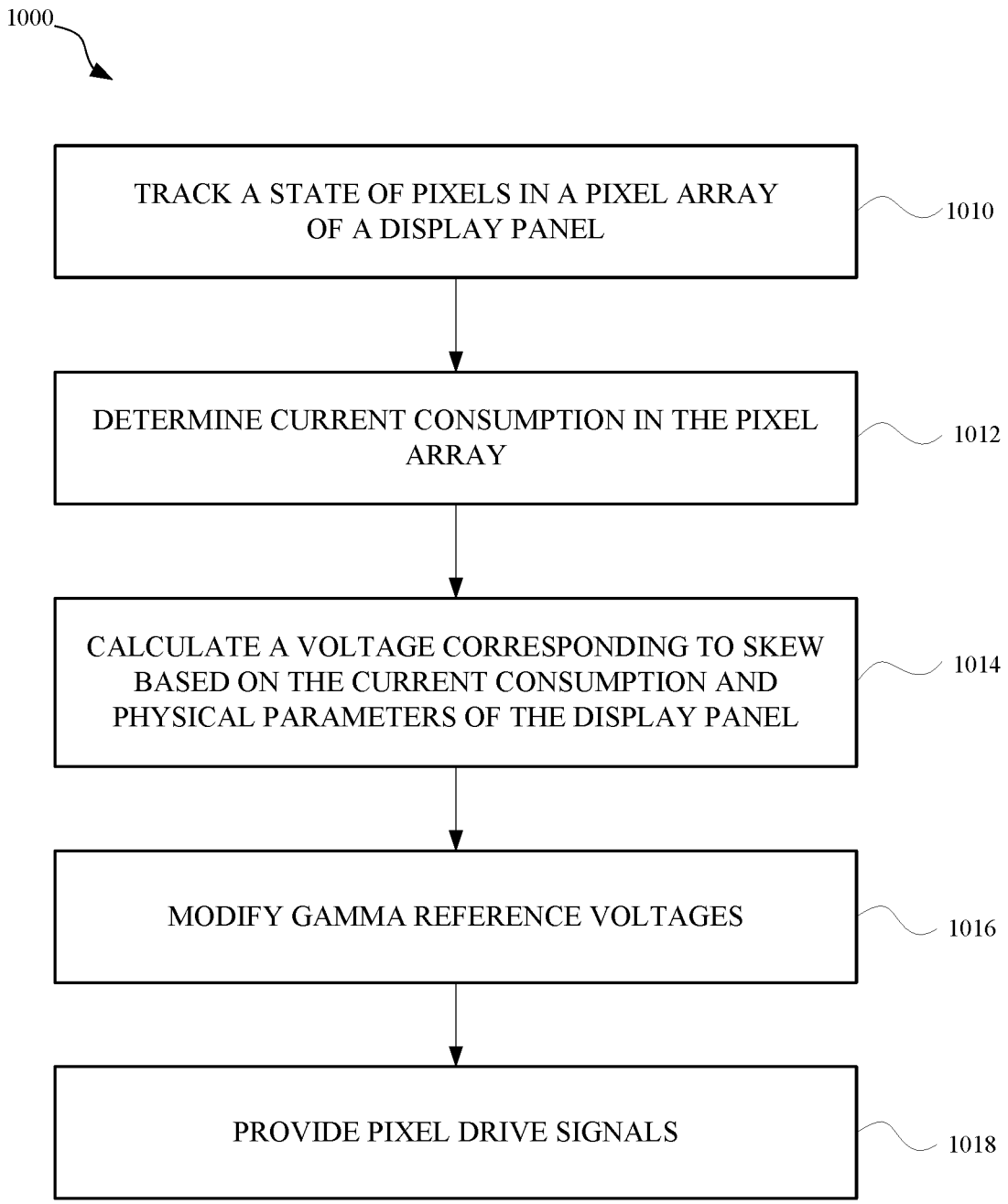
FIG. 10 illustrates a method for correcting for skew in a display panel.

FIG. 10 illustrates a method for correcting for skew in a display panel. Method 1000 can be performed by a processor, a display panel, a display driver, controller, a computing device connected to a display panel (such as graphical processing unit), a software module stored by a computing device, or any other suitable device for controlling a display panel. (Thus, in general, method 1000 may be performed in hardware and/or software.) For example, method 1000 can be embodied as software stored by a computing device connected to a display panel. In this way, the software can modify image data before the image data is provided to the display panel in order to reduce non-uniform luminance and/or chrominance exhibited by the display panel. However, in some embodiments, method 1000 is embodied as software stored by a display panel in order to modify image data after the image data is received by the display panel in order to reduce non-uniform luminance and/or chrominance exhibited by the display panel. In the discussion that follows, a display driver is used as an illustrative example of a component that implements method 1000.

During operation, the display driver tracks a state of the pixels (operation 1010) in a pixel array in the display panel (such as an OLED display), where the state is based on at least a portion of a current frame of image data displayed in the pixel array and at least a portion of a previous frame of image data displayed in the pixel array.

Then, based on the state, the display driver determines current consumption in the pixel array (operation 1012). Moreover, the display driver calculates a voltage corresponding to skew based on the current consumption and physical parameters of the display panel (operation 1014). For example, the physical parameters may include resistance. Alternatively or additionally, using a predetermined calibration that maps the state to a gamma reference voltage offset.

Next, based on the voltage and/or the predetermined calibration, the display driver modifies the gamma reference voltages (operation 1016) of pixels in the pixel array. For example, the gamma reference voltages may be modified on a pixel-by-pixel basis. Alternatively, the gamma reference voltages may be modified over a region that includes multiple pixels, i.e., pixels in the region may be assigned a common gamma reference voltage. Note that the modification may be implemented in the analog and/or in the digital domain. Thus, the modification may be to a digital representation of the image data in the current frame that correspond to the pixels and/or to pixel drive signals. Alternatively or additionally, a supply voltage applied to the pixel array may be modified to correct for skew.

Moreover, the display driver may provide pixel drive signals (operation 1018) that include the gamma values to the display panel.

Thus, the modification may correct for an error in the luminance and/or the chrominance of the pixel array that is associated with skew in pixel drive signals in the pixel array.

The modification may be determined based at least on: a location in the pixel array; a geometry of the pixel array (such as a geometry and/or an aspect ratio of the pixel array); and physical parameters of the pixel array (such as resistances). In some embodiments, the modification is determined based at least on a scan direction (such as top-to-bottom or left-to-right) during refresh of the pixel array. In general, the modification may depend on the location of a pixel relative to a supply voltage and how the state of the display panel is changed, i.e., the scan direction or the column drivers. Moreover, the modification may depend on a temperature of the pixel array (which may modify the physical parameters). For example, a temperature sensor (such as a resistive temperature sensor, a diode, etc.) in or proximate to the display panel may determine or measure the temperature of the pixel array, and the temperature measurement may be used to modify the calculation of the modification. Alternatively or additionally, the modification may be determined based on a predefined calibration constant corresponding to variation in luminance and/or chrominance across the pixel array, which may be determined using a calibration technique (as described further below with reference to FIG. 14).

Figure 11:
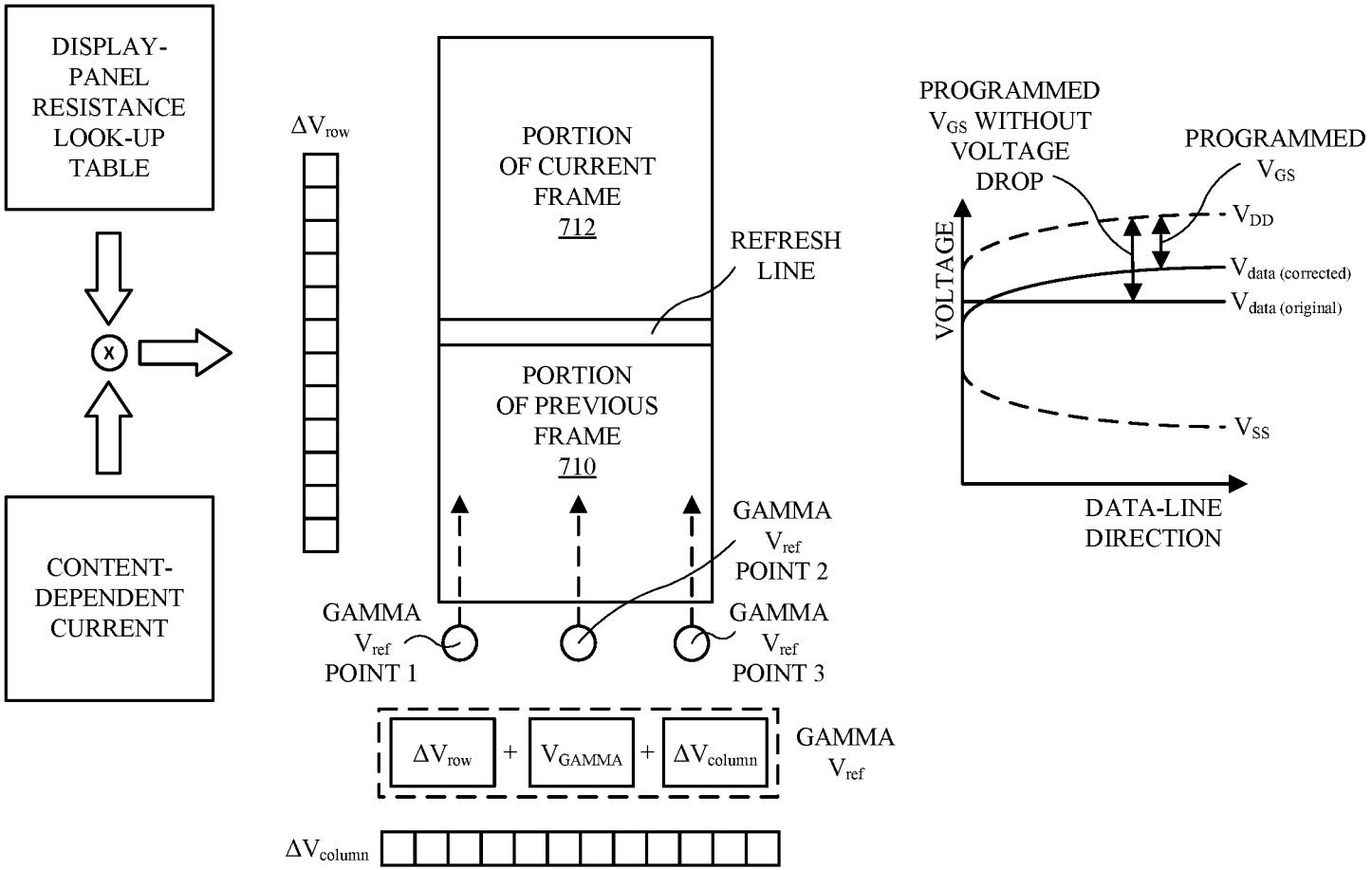
FIG. 11 illustrates correcting for skew in a display panel.

An example of the display technique is shown in FIG. 11, which illustrates a technique for correcting for skew in a display panel. In particular, the current consumption of each area or region in the pixel array is calculated based on the display content or state, including, in general, a portion of a previous frame that is displayed and a portion of a current frame that is displayed. Then, the correction AV is estimated based on the panel resistance and, more generally, one or more physical parameters of the display panel. Note that the one or more physical parameters may be captured during a calibration procedure or technique when the display panel was manufactured. Thus, the mapping from the current consumption to the correction may be predetermined and stored in a look-up table. Moreover, the correction is applied by adjusting, e.g., an analog gamma reference voltage during panel refresh. By changing the gate voltage applied to the pixels instead of changing the digital representation of the image data, the dynamic range may not be adversely impacted. For example, changing the gamma reference voltage(s) of the display drivers may be equivalent to changing a common mode of the pixel drive signals.

Figure 12:
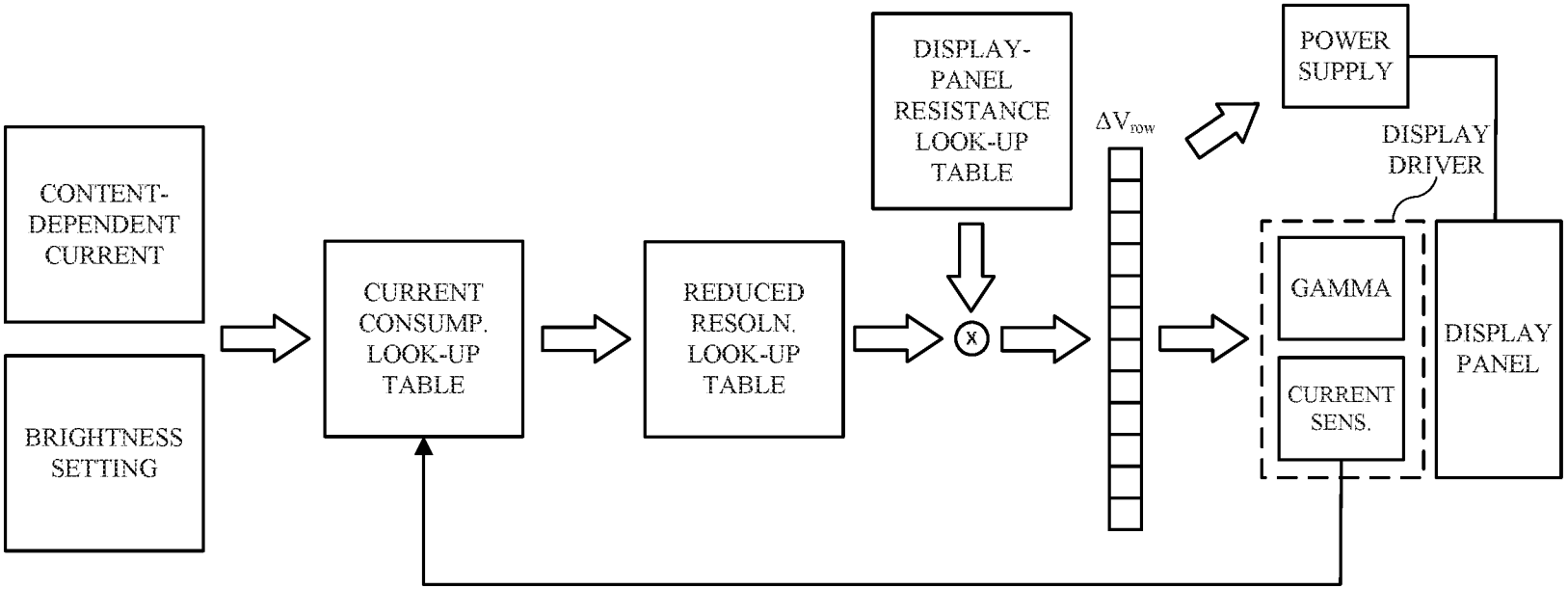
FIG. 12 illustrates correcting for skew in a display panel.

Another example of the display technique is shown in FIG. 12, which illustrates a technique for correcting for skew in a display panel. In particular, the current consumption of the pixel array may be estimated based on the display content or stated and the display-panel resistance. Alternatively, current sensing capability (such as a current sensor) may be included to update the predetermined look-up table to improve the accuracy of the correction. In addition, as shown in FIG. 12, the modification or correction may be based on a brightness setting, such as a total range of greyscale (such as 0 to 255). More generally, the modification may be based on a light condition.

In FIG. 12, a look-up table is used to map from the display state to the current consumption. The estimated or measured current consumption may be averaged or converted to current consumption over regions using another look-up table. Then, a look-up table of display-panel resistance may be used to convert the current consumption into a skew-dependent voltage. Based on this voltage, a display driver may modify the gamma reference voltage applied, via pixel drive signals, to the rows in the display panel. Alternatively or additionally, the supply voltage applied to the display panel may be modified.

Figure 13:
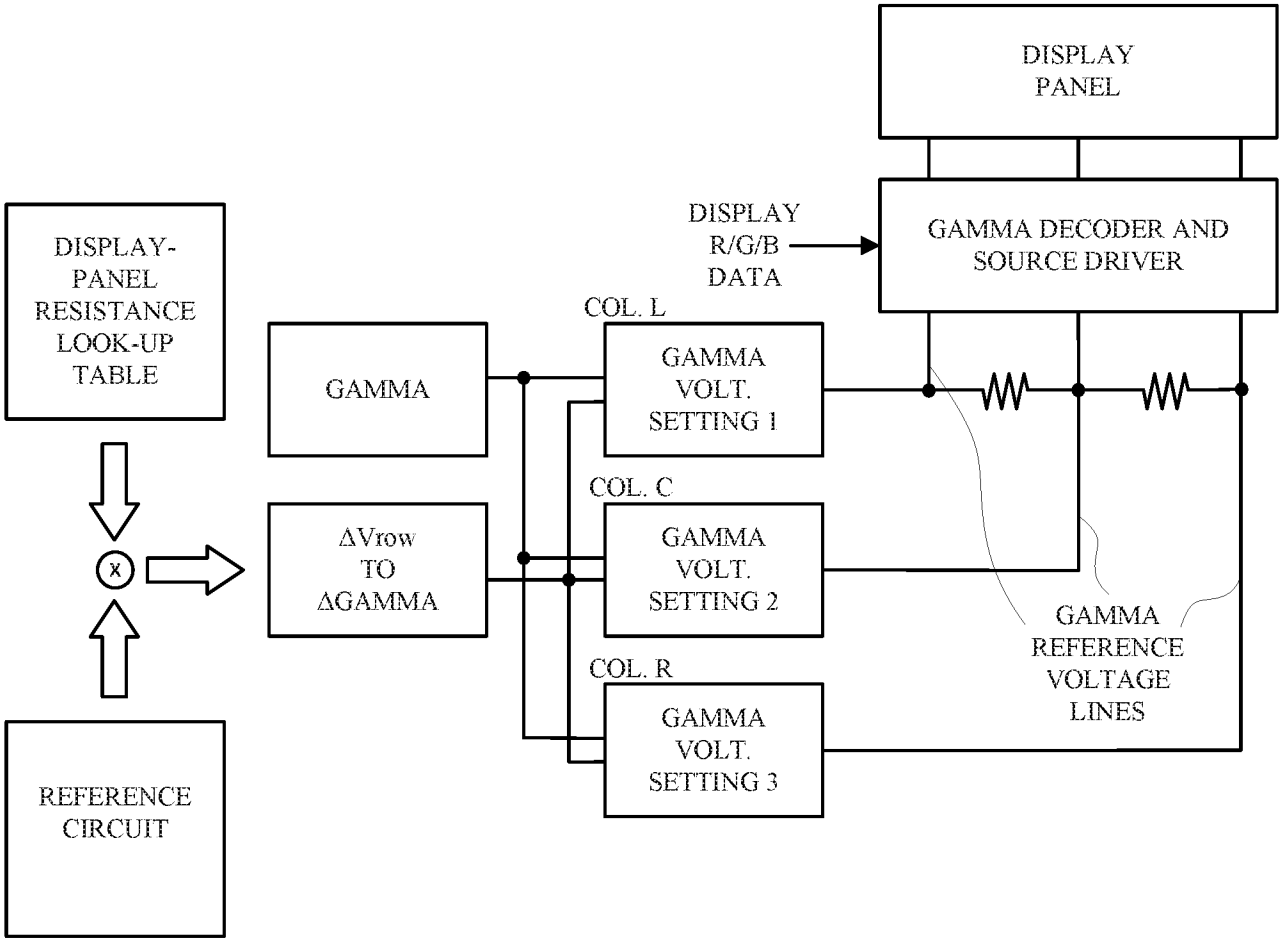
FIG. 13 illustrates correcting for skew in a display panel.

Similarly, as shown in FIG. 13, which illustrates a technique for correcting for skew in a display panel, the horizontal red, green or blue voltage offset associated with skew may be converted into a gamma offset based on different brightness settings. In particular, a 'micro-gamma' reference voltage may be used to compensation uniformly for variation of each pixel along each row in the analog domain. Note that in the vertical direction the voltage setting may be updated because the display panel may be driven line by line.

Figure 14:
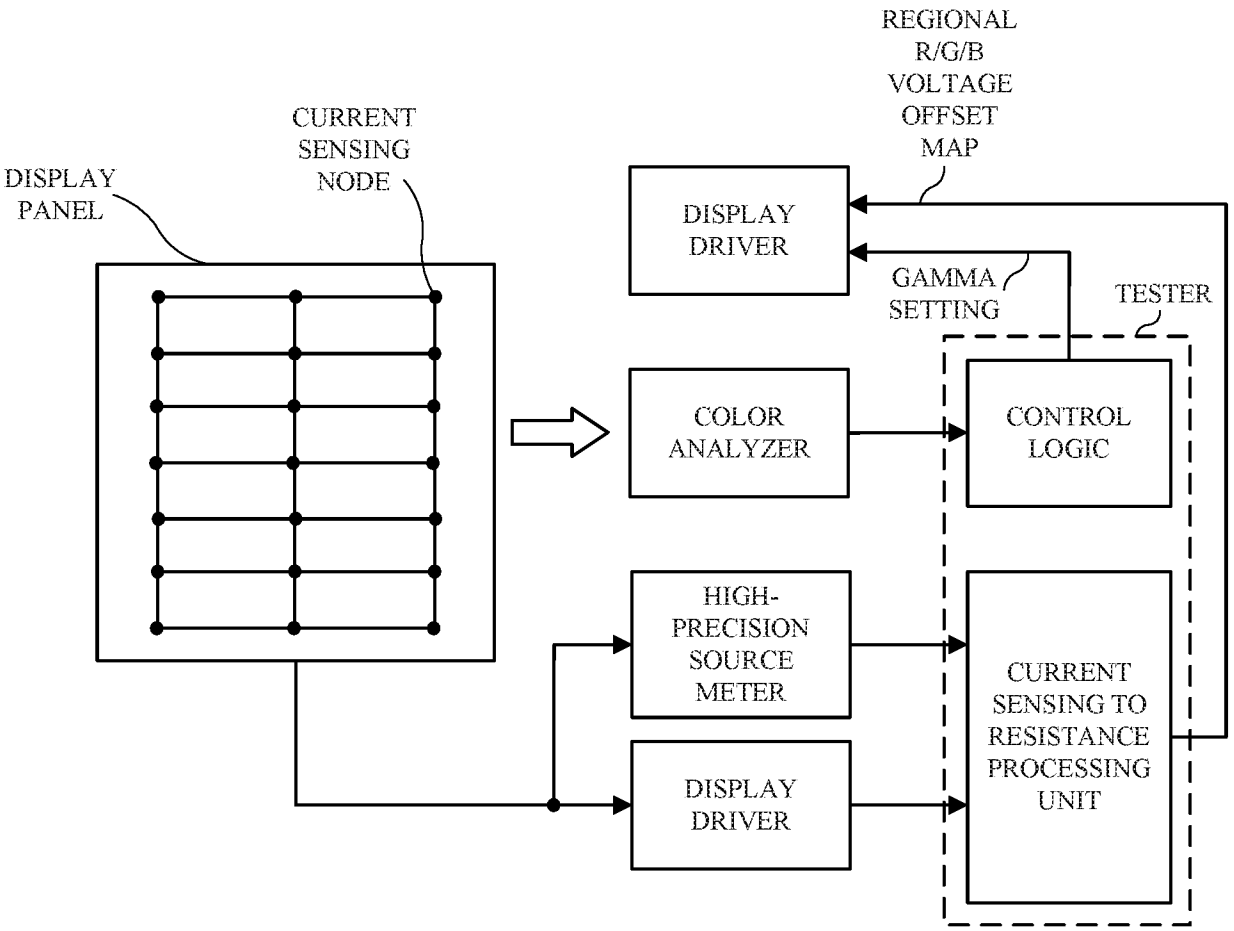
FIG. 14 illustrates determination of calibration factors for a display panel.

FIG. 14 illustrates determination of calibration factors for a display panel. In particular, the current consumption may be sensed or measured at current sensing nodes (such as 10×10 pixels) when the display panel displays at, e.g., 21 locations (3×7) red, green and/or blue light. This current measurement may be performed using an external source meter or may be included in the display driver. In general, the resolution and the positions of the current sensing nodes may be adjusted based on the display-panel size, the geometry of the pixel array and/or the average data loading or state. Moreover, when the same image data is displayed at the top of bottom of the pixel array, the current consumption may vary because of the routing resistance. In FIG. 14, by analyzing or determining the color variation, a mapping from the current consumption to the gamma reference voltage (which may be stored in a look-up table) may be determined. Note that this calibration procedure may capture information about the impact of DC voltage drops and the dynamic voltage associated with skew.

Figure 15:
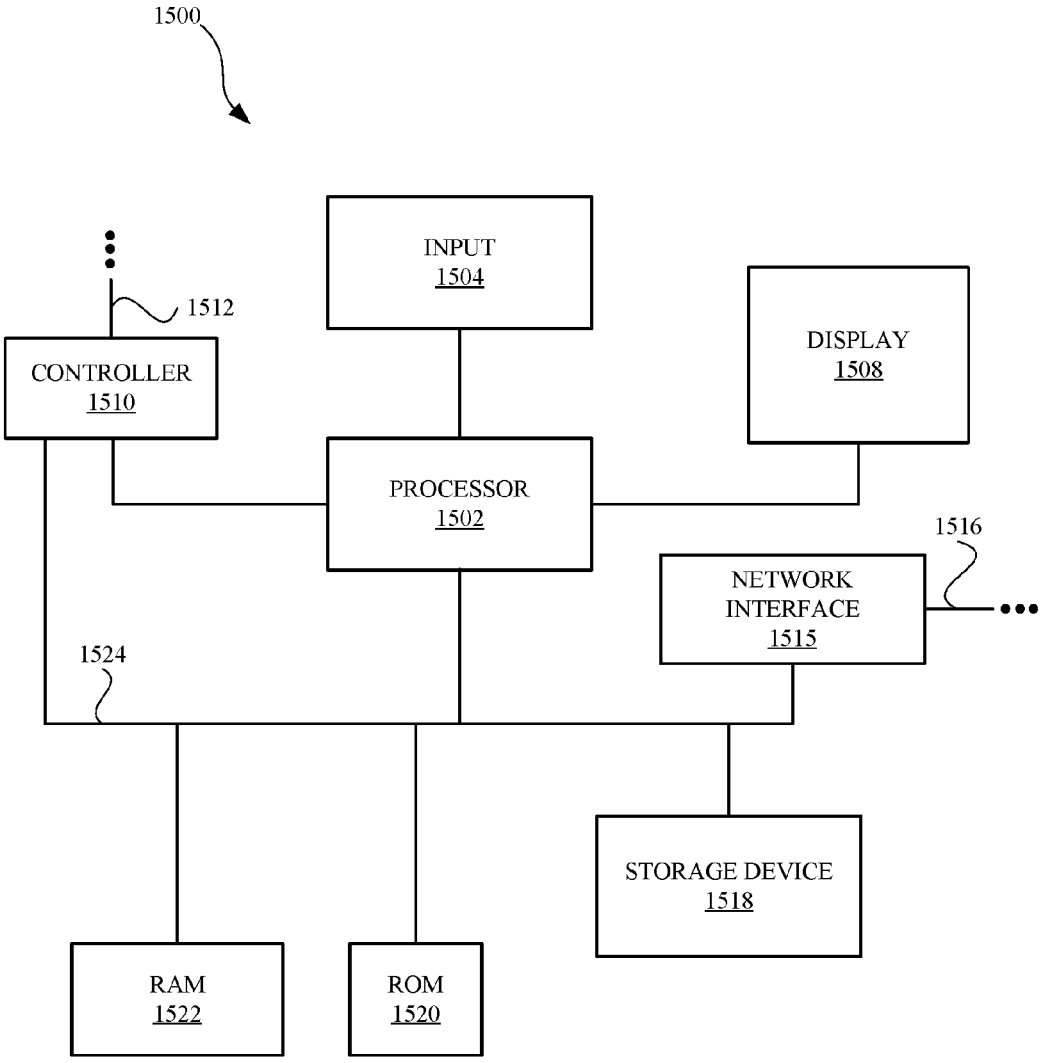
FIG. 15 is a block diagram of a device that can represent the components of a computing device or any other suitable device or component for realizing any of the methods, systems, apparatus, and embodiments discussed herein.

FIG. 15 is a block diagram of a computing device 1500 that can represent the components of a computing device 100 or any other suitable device or component for realizing any of the methods, systems, apparatus, and embodiments discussed herein. It will be appreciated that the components, devices or elements illustrated in and described with respect to FIG. 15 may not be mandatory and thus some may be omitted in certain embodiments. The computing device 1500 can include a processor 1502 that represents a microprocessor, a coprocessor, circuitry and/or a controller for controlling the overall operation of computing device 1500. Although illustrated as a single processor, it can be appreciated that the processor 1502 can include a plurality of processors. The plurality of processors can be in operative communication with each other and can be collectively configured to perform one or more functionalities of the computing device 1500 as described herein. In some embodiments, the processor 1502 can be configured to execute instructions that can be stored at the computing device 1500 and/or that can be otherwise accessible to the processor 1502. As such, whether configured by hardware or by a combination of hardware and software, the processor 1502 can be capable of performing operations and actions in accordance with embodiments described herein.

The computing device 1500 can also include user input device 1504 that allows a user of the computing device 1500 to interact with the computing device 1500. For example, user input device 1504 can take a variety of forms, such as a button, keypad, dial, touch screen, audio input interface, visual/image capture input interface, input in the form of sensor data, etc. Still further, the computing device 1500 can include a display 1508 (screen display) that can be controlled by processor 1502 to display information to a user. Controller 1510 can be used to interface with and control different equipment through equipment control bus 1512. The computing device 1500 can also include a network/bus interface 1514 that couples to data link 1516. Data link 1516 can allow the computing device 1500 to couple to a host computer or to accessory devices. The data link 1516 can be provided over a wired connection or a wireless connection. In the case of a wireless connection, network/bus interface 1514 can include a wireless transceiver.

The computing device 1500 can also include a storage device 1518, which can have a single disk or a plurality of disks (e.g., hard drives) and a storage management module that manages one or more partitions (also referred to herein as "logical volumes") within the storage device 1518. In some embodiments, the storage device 1518 can include flash memory, semiconductor (solid state) memory or the like. Still further, the computing device 1500 can include Read-Only Memory (ROM) 1520 and Random Access Memory (RAM) 1522. The ROM 1520 can store programs, code, instructions, utilities or processes to be executed in a non-volatile manner. The RAM 1522 can provide volatile data storage, and store instructions related to components of the storage management module that are configured to carry out the various techniques described herein. The computing device 1500 can further include data bus 1524. Data bus 1524 can facilitate data and signal transfer between at least processor 1502, controller 1510, network/bus interface 1514, storage device 1518, ROM 1520, and RAM 1522.

The various aspects, embodiments, implementations or features of the described embodiments can be used separately or in any combination. Various aspects of the described embodiments can be implemented by software, hardware or a combination of hardware and software. The described embodiments can also be embodied as computer readable code on a computer readable storage medium. The computer readable storage medium can be any data storage device that can store data, which can thereafter be read by a computer system. Examples of the computer readable storage medium include read-only memory, random-access memory, CD-ROMs, HDDs, DVDs, magnetic tape, and optical data storage devices. The computer readable storage medium can also be distributed over network-coupled computer systems so that the computer readable code is stored and executed in a distributed fashion. In some embodiments, the computer readable storage medium can be non-transitory.

The foregoing description, for purposes of explanation, used specific nomenclature to provide a thorough understanding of the described embodiments. However, it will be apparent to one skilled in the art that the specific details are not required in order to practice the described embodiments. Thus, the foregoing descriptions of specific embodiments are presented for purposes of illustration and description. They are not intended to be exhaustive or to limit the described embodiments to the precise forms disclosed. It will be apparent to one of ordinary skill in the art that many modifications and variations are possible in view of the above teachings.

What is claimed is:

1. A display panel, comprising:

a pixel array with pixels arranged in rows; and a display driver configured to:

track a state of the pixels, wherein the state is based on at least a portion of a current frame of image data displayed in the pixel array and at least a portion of a previous frame of image data displayed in the pixel array;

determine a correction on a pixel-by-pixel basis in at least a row based on voltage drops in the pixel array;

based on the correction, modify, on the pixel-by-pixel basis in at least the row, at least one of: a supply voltage applied to the pixel array; a digital representation of the image data in the current frame that correspond to the pixels; and pixel drive signals corresponding to the image data in the current frame; and provide the pixel drive signals to at least the row, wherein the digital representation of the image data is modified by changing gamma values on a pixel-by-pixel basis in at least the row.

2. The display panel of claim 1, wherein the correction corresponds to at least one of: a luminance error; and a chrominance error.

3. The display panel of claim 1, wherein the pixel array includes organic light emitting diodes (OLEDs).

4. The display panel of claim 1, wherein the correction is determined based at least on: a location in the pixel array; a geometry of the pixel array; and physical parameters of the pixel array.

5. The display panel of claim 4, wherein the correction is further determined based on a scan direction during refresh of the pixel array.

6. The display panel of claim 1, wherein the correction is determined based on a temperature of the pixel array.

7. The display panel of claim 1, wherein the correction is determined by calculating the voltage drops based on current in the pixel array.

8. The display panel of claim 1, wherein the correction is determined using a one-dimensional calculation or a two-dimensional calculation.

9. The display panel of claim 1, wherein the correction is determined based on a predefined calibration constant corresponding to variation in luminance or chrominance across the pixel array.

10. A method for correcting for voltage drops in a pixel array with pixels arranged in rows, the method comprising:

by a display driver:

tracking a state of the pixels, wherein the state is based on at least a portion of a current frame of image data displayed in the pixel array and at least a portion of a previous frame of image data displayed in the pixel array;

determining a correction on a pixel-by-pixel basis in at least a row based on voltage drops in the pixel array;

based on the correction, modifying, on the pixel-by-pixel basis in at least the row, at least one of: a supply voltage applied to the pixel array; a digital representation of the image data in the current frame that correspond to the pixels; and pixel drive signals corresponding to the image data in the current frame; and providing the pixel drive signals to at least the row, wherein modifying the digital representation of the image data involves changing gamma values on a pixel-by-pixel basis in at least the row.

11. The method of claim 10, wherein the correction corresponds to at least one of: a luminance error; and a chrominance error.

12. The method of claim 10, wherein the correction is determined based at least on: a location in the pixel array; a geometry of the pixel array; and physical parameters of the pixel array.

13. The method of claim 12, wherein the correction is further determined based on a scan direction during refresh of the pixel array.

14. The method of claim 10, wherein the correction is determined based on a predefined calibration constant corresponding to variation in luminance or chrominance across the pixel array.

15. A display driver, comprising:

outputs configured to provide pixel drive signals to at least a row of pixels in a pixel array of a display panel, wherein the pixel drive signals correspond to image data in a current frame;

a memory configured to store a current state of the display panel, wherein the current state is based on at least a portion of the current frame of the image data currently displayed in the pixel array and at least a portion of a previous frame of image data currently displayed in the pixel array; and a correction circuit configured to:

determine a correction on a pixel-by-pixel basis in at least the row based on voltage drops in the pixel array, each voltage drop associated with at least one pixel and determined based on the current state of the display panel; and based on the correction, modify, on the pixel-by-pixel basis in at least the row, at least one of: a supply voltage applied to the pixel array; a digital representation of the image data in the current frame that correspond to the pixels; and the pixel drive signals.

16. The display driver of claim 15, wherein the memory is further configured to store a predefined calibration constant corresponding to variation in luminance or chrominance across the pixel array; and wherein the correction is determined based on the predefined calibration constant.

17. The display driver of claim 16, wherein the predefined calibration constant is associated with a group of pixels.

18. The display driver of claim 15, wherein the correction is determined based at least on: a location in the pixel array; a geometry of the pixel array; and physical parameters of the pixel array.

19. The display driver of claim 15, wherein the correction circuit is further configured to:

determine a current consumption by the display panel based on the current state; and determine a skew correction for the image data based on the current consumption.

* * * * *